US005802432A

United States Patent [19]

Coffey et al.

[11] Patent Number: 5,802,432

[45] Date of Patent: Sep. 1, 1998

[54] TONER CARTRIDGE WITH HOUSING AND PIN CONSTRUCTION

[75] Inventors: Johnnie A. Coffey, Winchester; Steven Alan Curry, Nicholasville; Larry Steven Foster, Lexington; Paul Douglas Horrall, Lexington; John Randolph McIntyre, Lexington; Richard Alden Ramsdell, Lexington; David Erwin Rennick, Georgetown, all of Ky.

[73] Assignee: Lexmark International, Inc., Lexington, Ky.

[21] Appl. No.: 770,330

[22] Filed: Dec. 20, 1996

[51] Int. Cl.[6] ..... G03G 21/18

[52] U.S. Cl. ..... 399/110; 399/113

[58] Field of Search ..... 399/110, 111, 399/113, 119

[56] References Cited

U.S. PATENT DOCUMENTS

| | | | |
|---|---|---|---|
| 4,530,588 | 7/1985 | Kimura et al. | 355/3 DR |
| 4,873,940 | 10/1989 | Ishikawa et al. | 118/651 |
| 4,928,146 | 5/1990 | Yamada | 355/200 |
| 5,012,289 | 4/1991 | Aldrich et al. | 355/260 |
| 5,019,867 | 5/1991 | Yamakawa et al. | 355/245 |
| 5,028,966 | 7/1991 | Kozuka et al. | 355/260 |
| 5,036,367 | 7/1991 | Haneda et al. | 355/260 |
| 5,083,158 | 1/1992 | Kashima et al. | 355/200 |
| 5,101,237 | 3/1992 | Molloy | 355/245 |
| 5,136,333 | 8/1992 | Craft et al. | 355/211 |
| 5,331,378 | 7/1994 | Baker et al. | 355/210 |
| 5,337,032 | 8/1994 | Baker et al. | 355/260 |
| 5,365,315 | 11/1994 | Baker et al. | 355/210 |
| 5,410,387 | 4/1995 | Yamada | 355/200 |
| 5,500,714 | 3/1996 | Yashiro et al. | 355/200 |
| 5,526,097 | 6/1996 | Ream | 355/219 |
| 5,528,342 | 6/1996 | Setoriyama | 355/200 |
| 5,543,891 | 8/1996 | Setoriyama | 355/200 |
| 5,543,898 | 8/1996 | Shishido et al. | 355/210 |
| 5,550,617 | 8/1996 | Odagawa et al. | 355/210 |

OTHER PUBLICATIONS

IBM Technical Disclosure Bulletin, Aug. 1990, vol. 33, No. 3B, pp. 29–30, Toner Seal For Printer.

Taguchi Dynamic Characteristics Applied to Initial Design Concept Analysis, E.D. Ward, Twelfth Annual Taguchi Symposium, 1994, Rochester, New York, pp. 1–24 and Conclusions (1 p; not numbered).

*Primary Examiner*—Joan H. Pendegrass
*Attorney, Agent, or Firm*—John A. Brady

[57] ABSTRACT

Toner cartridge (1) has a unitary assembly forming the handle (3a, 3b), the cover (25), side walls (33, 245) and the cleaner chamber (27) and hold the photoconductor drum (43). Each of the side walls has a U-shaped housing (35, 247) which loosely receives a pin (37a, 37b) from the side of the hopper (61). The hopper is part of a unitary assembly holding the toner adder roller (45) and the developer roller (43). Second pins (131a, 131b) from the sides of the hopper carry springs which pull the two assemblies together to press the developer roller against the photoconductor. The hopper also has flat ledges (161a, 133a) on each side for movement on roller in the printer. This further permits the cartridge to have central locating elements (29a, 29b), wing-like guides (9a, 9b) for insertion, links (13a, 13b) to open a lower shutter (7), and unobstructed ends of photoconductor shaft (47) for positively locating on that shaft.

10 Claims, 23 Drawing Sheets

TONER CARTRIDGE WITH HOUSING AND PIN CONSTRUCTION

CROSS-REFERENCE TO RELATED APPLICATIONS

The following United States patent applications are directed to subject matter disclosed or incorporated in the disclosure of this application Ser. No. 08/602,648, filed Feb. 16, 1996, now U.S. Pat. No. 5,634,169 entitled "Multiple Function Encoder Wheel for Cartridges Utilized in an Electrophotographic Output Device; five utility applications filed the same day as this application entitled "Toner Cartridge with External Planar Installation Guides, " Ser. No. 08/770,327,"Toner Cartridge with Hopper Exit Agitator, " Ser. No. 08/770,328; "Toner Cartridge with Locating on Photoconductor Shaft, " Ser. No. 08/770,326, "Toner Cartridge with Heat Shield Shutter, " Ser. No. 08/770,326; and "Venting Plug in Toner Cartridge;" Ser. No. 08/770,326 and one ornamental design application filed the same day as this application entitled "Toner Cartridge for Laser Printer," Ser. No. 29/066,775

TECHNICAL FIELD

This invention relates to electrophotographic development and, more particularly, relates to a toner cartridge having no toner pump and associated structure.

BACKGROUND OF THE INVENTION

The assignee of this invention has manufactured and sold commercially toner cartridges of two different general designs. For its larger laser printers the cartridge has contained a pump to meter toner of the kind disclosed in U.S. Pat. Nos. 5,012,289 to Aldrich et al. and 5,101,237 to Molloy, while the external structure of the cartridge is as disclosed in U.S. Pat. No. 5,136,333 to Craft et al. Details of other elements in the cartridge have varied.

For a smaller, light emitting diode printer, the cartridge is as disclosed in U.S. Pat. No. 5,337,032 to Baker et al., which has a toner hopper extending well below a level having the toner adder roller and which has independent drive systems for the photoconductor roller and for the developer roller system as disclosed in U.S. Pat. No. 5,331,378 to Baker et al.

This invention employs a loose housing and pin connection between the photoconductor assembly and the hopper assembly.

Prior cartridges have had at least three wheels riding on tracks connecting the hopper assembly to the housing and photoconductor assembly. These wheels define a plane in which the two assemblies have to adjust the contact force between the developer roller in the hopper assembly and the photoconductor roller in the housing assembly. Having all of those wheels in the cartridge is detrimental in that they add to the positional variations of the developer unit with respect to the paper path. Also, during rough handling the forward wheels in the cartridge tend to break off under the weight of the toner.

In this invention only the two rear rollers are in the cartridge. Two rollers which correspond to two front wheels in the former cartridge are in the printer. The hopper in the cartridge have flat surfaces which receive these cartridges.

DISCLOSURE OF THE INVENTION

The toner cartridge of this invention has a first or unitary element making up a handle, a cover and a cleaner chamber and holding the photoconductor drum. Each of the two side walls has a housing which loosely receives a pin of a second, single element. The second single or unitary element holds a developer roller and has a toner hopper having two pins on each side, one of the pins fitting in each of the housings. The second pins connect the two single elements for yieldably pressing the developer roller against the photoconductor drum, as is generally conventional.

Since the hopper element is only loosely connected to the cover element, the hopper can adjust by movement with respect to the frame of a printer on which it is mounted. This is facilitated by the hopper having a flat ledge on each side for resting on rollers in the printer. The preferred design has central locating elements to receive pressure from the printer on the top, curved planar guide wing-like element on each side, a link to a lower shutter on each side above the wing-like guides which will be moved to open the shutter when the guides are inserted in the printer, the central shaft of the photoconductor is unobstructed to serve as a lower locator.

Since the under side of the developer unit is part of the media path, referencing the hopper assembly to the printer improves location accuracy of the media path. The cartridge is resistant to rough handling, while the corresponding wheels in the former cartridges tended to break. A minor advantage is that the cost of the wheels and their installation is eliminated from the cartridge.

BRIEF DESCRIPTION OF THE DRAWINGS

The details of this invention will be described in connection with the accompanying drawing, in which.

BEST MODE FOR CARRYING OUT THE INVENTION

Figure 1:
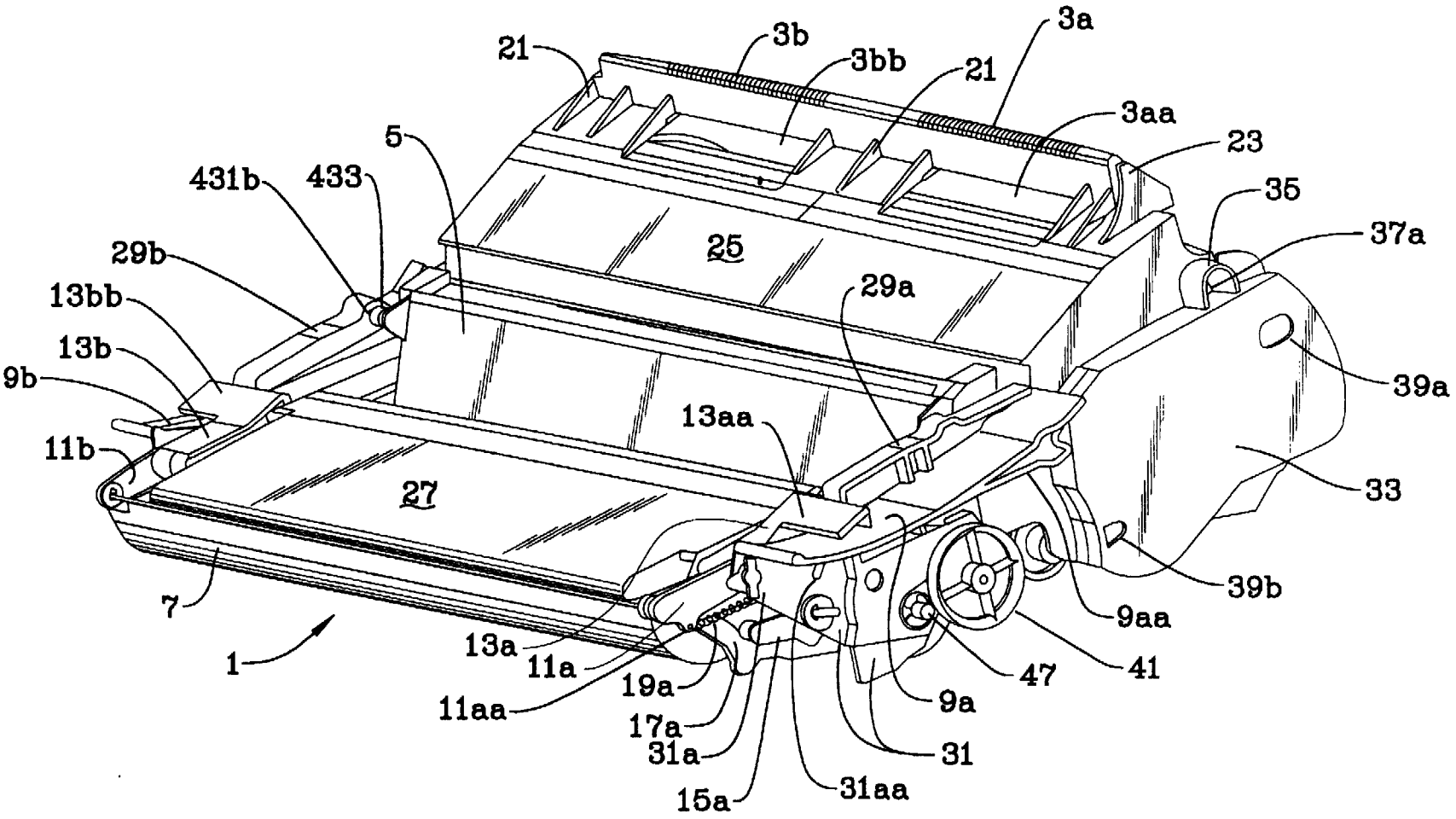
FIG. 1 is a perspective view of the toner cartridge from above and left rear, where left is determined facing the printer from its front side where cartridge insertion is made.

The self-contained, removable printer cartridge 1 is shown in FIG. 1 in a perspective view from above and left rear (the hand grips 3*a* and 3*b* being considered the front and the side having the pivoted upper shutter 5 being the upper side).

For purposes of illustration, FIG. 1 shows the upper shutter 5 pivoted downward to its open position and lower shutter 7 pivoted rearward and upward to its open position. In actual operation, these positions are reached by interaction with the printer or other device in which cartridge 1 is installed as will be explained below.

To facilitate and guide insertion of cartridge 1 into the printer, cartridge 1 has a left guide wing 9*a* and a right guide wing 9*b*. Guide wings 9*a* and 9*b* are thin planes formed as arcs of a relatively large circle, except near the front, where the bottom 9*aa* is enlarged downward. Guide wings 9*a* and 9*b* are mirror images of each other except that, in this particular embodiment described, the left guide wing 9*a* is wider (extends further laterally) than the right guide wing 9*b* simply to accommodate the width provided by a particular printer in which the exemplar cartridge 1 is to be installed.

In the embodiment herein described, bottom shutter 7 is pivoted from left-rear cover 31*a* on a left top actuator link arm 11*a* and from rear cover (not shown) on a right top actuator link arm 11*b*, located on opposite sides of shutter 7. Each link arm 11*a*, and 11*b* is integral with an actuator 13*a*, and 13*b*, respectively, each of which has a rectangular actuator surface 13*aa* and 13*bb*, respectively, which extends over the respective guide wings 9*a*, 9*b*.

A pivoted lower shutter link 15*a* and a side of the lower shutter 17*a*, pivoted to lower shutter link 15*a* left top actuator link arm and upper actuator link 11*a* complete a conventional four bar linkage to provide rotation of shutter 7 in response to rotation of actuator 13*a*. The rear end of coil spring 19*a* connects to a lower hook 11*aa* in link arm 11*a* to bias shutter 7 closed when the cartridge is not inserted in a printer or other device. The front end of coil spring 19*a* connects to an upper hole 31*aa* under actuator 13*a*. A mirror image of these parts (see FIG. 3) exists on the opposite side, the corresponding part of which will be designated by the same number with "b" letters.

When cartridge 1 is installed in the printer, actuator surfaces 13*aa* and 13*bb* are pushed downward by the mating surfaces of the printer to the positions above wings 9*a*, 9*b* respectively, as shown in FIG. 1.

Cartridge 1 is inserted by a human operator grasping grips 3*a*, 3*b* through holes 3*aa*, 3*bb* and moving cartridge 1 in the direction of shutter 5 and toward the rear of the printer (291, FIG. 10) in which it is being installed. A series of upwardly extending ribs 21 spaced along the width of cartridge 1 under grips 3*a*, 3*b*, except at holes 3*aa* and 3*bb*, provide strength while holes 3*aa* and 3*bb* provide room for the fingers of a person to grasp grips 3*a*, 3*b*. On the left side is a relatively wide, upwardly extending tab 23. In a preferred combination of the embodiment of the invention described herein and an exemplary printer the top of tab 23 interacts with a physical sensing switch in the printer to detect that a cartridge 1 has been installed.

Front cover 25, on which grips 3*a*, 3*b*, ribs 21 and tab 23 are integrally formed, is above a separated toner hopper, as will be described. The top cover of cleaner chamber 27 is rearward of shutter 5.

Immediately inside wings 9*a* and 9*b* are raised, elongated locator surfaces 29*a*, 29*b* to which pressure is applied by a printer to firmly position the toning mechanisms of cartridge 1 when cartridge 1 is installed. Locator surfaces 29*a* and 29*b*, wings 9*a* and 9*b*, as well as rear cover 31 under wing 9*a*, are formed integral with cleaner housing 27. Also integral with these elements is front cover 25, having grips 3*a*, 3*b* and an outer cover 33 on the left side and generally coextensive in length with the length of front cover 25. Cover 33 has a U-shaped housing 35 at its top. Housing 35 traps spacer stud 37*a* as will be explained and an assembly hole 39*a* near the upper front of cover 33 and a spring-holding bole 39*b* near the lower front of cover 33.

A coupler 41 receives a drive element from a printer which contains an Oldham coupler to rotatably drive the developer roller 43 (not shown in FIG. 1) and toner adder roller 45 (not shown in FIG. 1). To the rear of coupler 41 is the shaft 47 of photoconductor drum 49 (drum not shown in FIG. 1).

Figure 2:
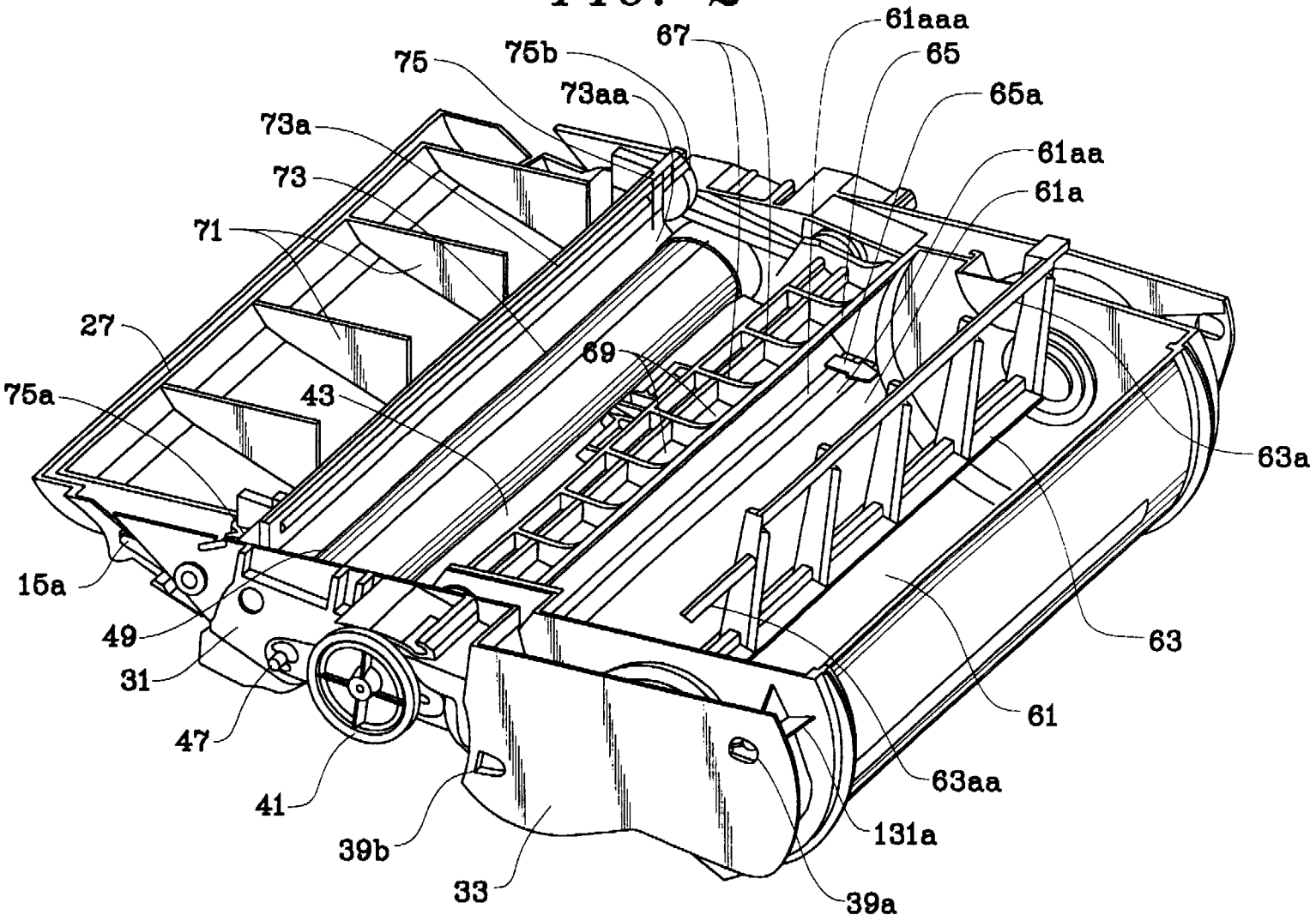
FIG. 2 is a perspective view from above and left front of the cartridge sectioned near the top.

FIG. 2 is a perspective view from above and left front of cartridge 1 sectioned near the top to show internal elements. At the immediate front is a large, cylindrical toner hopper 61, having a paddle 63, which, during operation, is rotated clockwise as seen in FIG. 2. Paddle 63 has an outer toner moving bar 63*a*, which extends across the width of hopper 61 except for a far left section 63*aa* which is inset as will be explained. The rear wall 61*a* of hopper 61 when cartridge 1 is installed for operation in a printer terminates at about one-third of the total height of hopper 61 as a flat surface 61*aa* (specifically, hopper 61 has a 106 mm diameter and the distance vertically from the lowest point of hopper 61 to the horizontal plane coinciding with the highest point surface 61*aa* of rear wall 61*a* is 35.3 mm). The upper surface 61*aa* of rear wall 61*a* is thin and flat with a slight downward angle from hopper 61 to facilitate removal of the molded part from its mold. An extension 65*a* from an agitator bar 65 has a depending tab 65*b* (see FIG. 9) which rests on upper wall 61*aa* thereby positioning agitator bar 65 slightly above upper wall 61*aa*. Extension 65*a* extends past upper wall 61*aa* to a location at which bar 63*a* of paddle 63 encounters extension 65*a* as it rotates. The surface 61*aaa* opposite surface 61*aa* from which toner exits is flat and at approximately 50 degrees from vertical (best seen in FIG. 9) when cartridge 1 is installed for operation in a printer.

Figure 9:
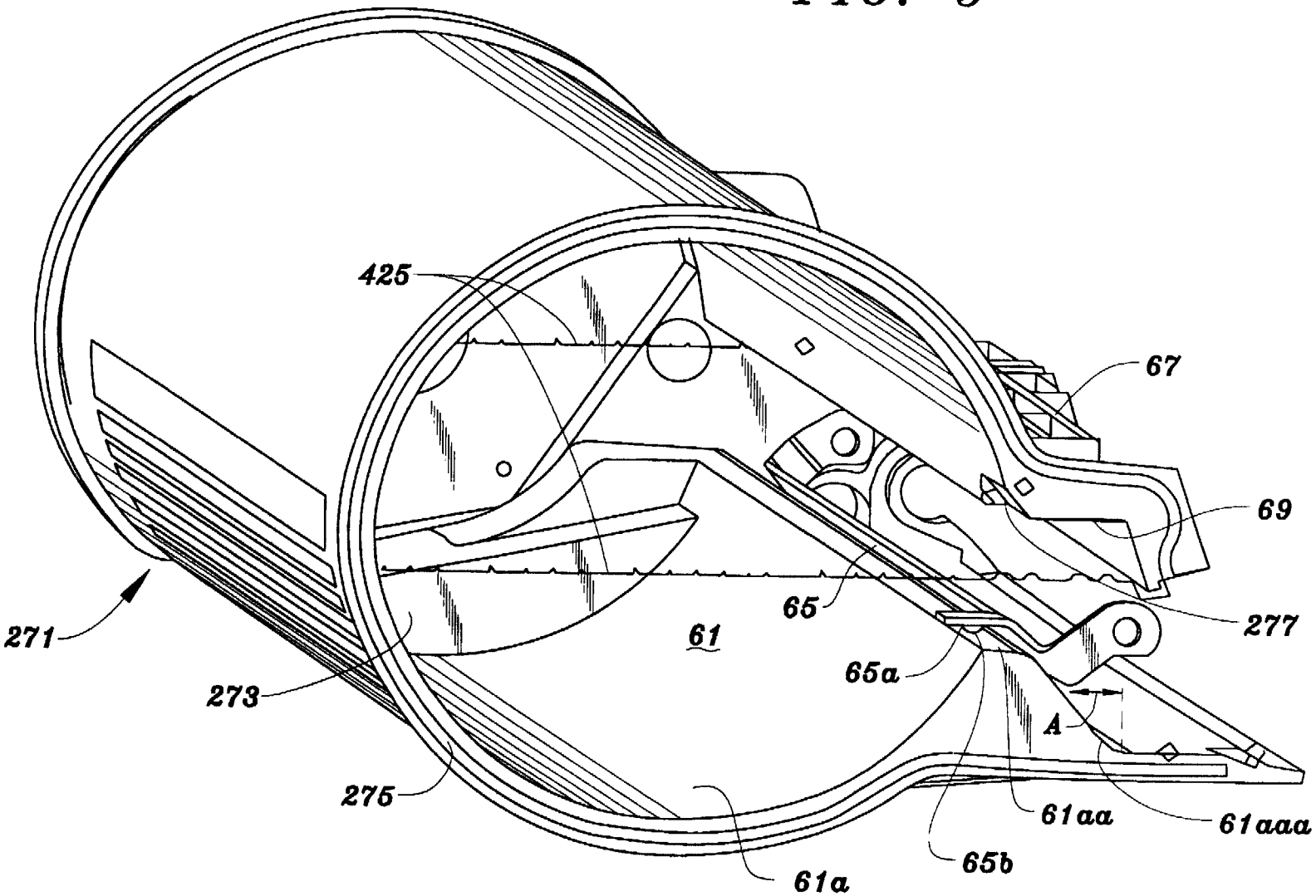
FIG. 9 is a front right perspective view of the hopper housing member.

Vertical ribs 67 located immediately rearward of rear wall 61*a* are stiffeners for top wall 69 formed about one-third down from the top of hopper 61. The toner moving bar 63*a* of paddle 63 is closely adjacent to the sides of hopper 61 except where the top of rear wall 61*a* and the start of top wall 69 form an opening for toner to be delivered rearward from hopper 61 to the toning mechanisms of cartridge 1. This is best shown in FIG. 9.

Figure 3:
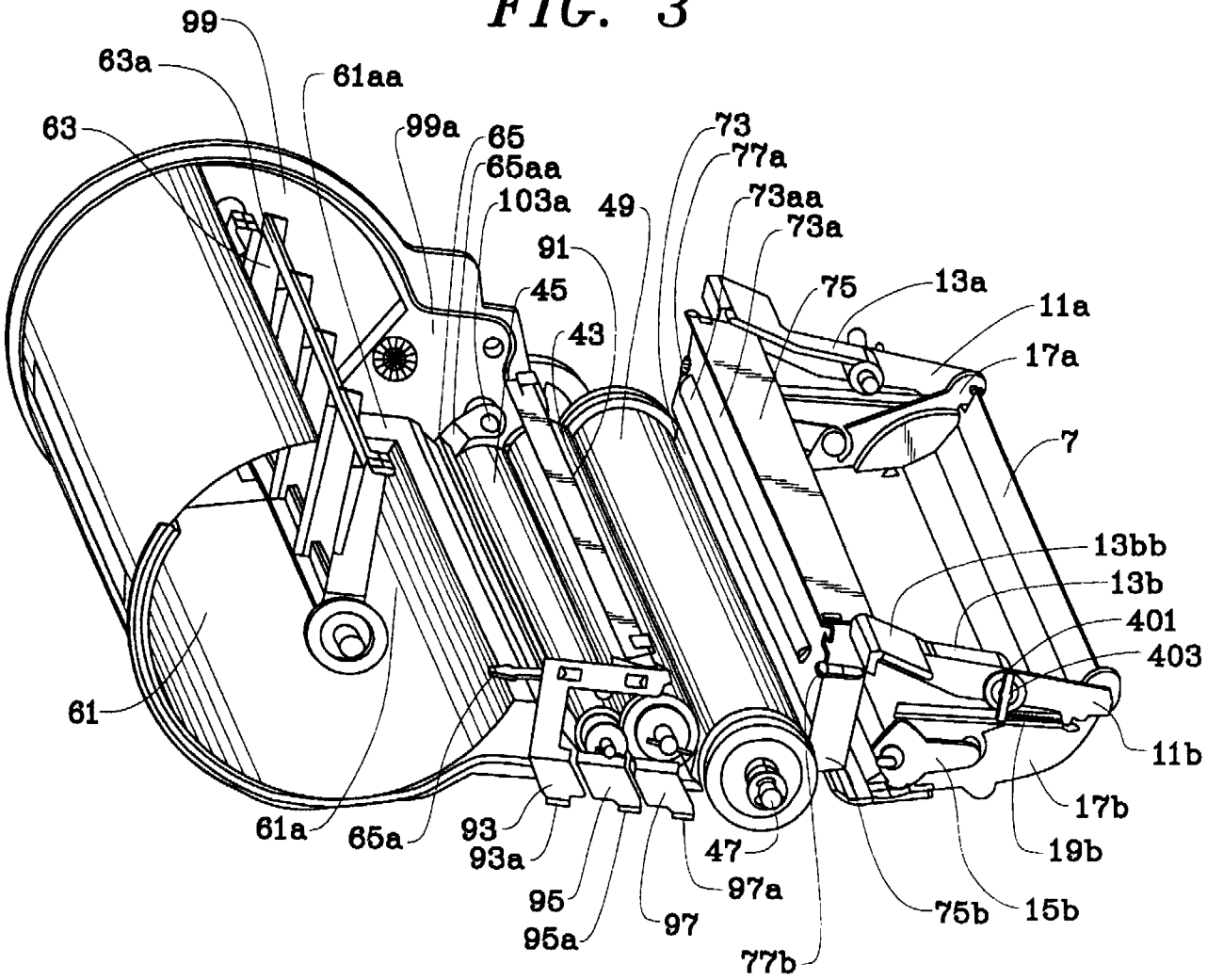
FIG. 3 is a top right front view of the cartridge with further cover elements removed.

In FIG. 2, a small part of developer roller 43 to which coupler 41 is directly attached, is seen past ribs 67. Developer roller 43 is parallel to and in contact with photoconductor drum 49. Cleaner chamber 27 has spaced, vertical internal baffles 71, which are strengthening members, as well as members which limit unbalanced accumulation of toner in chamber 27. Toner which is not transferred during development is scraped from photoconductor drum 49 by cleaning blade 73, which is mounted to a vertical panel 73*a*, having a horizontal gusset 73*aa* to increase strength. As best seen in FIG. 3, panel 73*a* is mounted to supporting member 75, which has vertical columns 75*a* (FIG. 2), 75*b* on opposite sides. Panel 73*a* is mounted to the vertical columns 75*a*, 75*b* by a screw 77*a* to column 75*a* and a screw 77*b* to column 75*b*.

FIG. 3 is a top right side view with further cover elements removed and part of the cleaner removed to illustrate the internal configuration of cartridge 1. A solid, steel-bar doctor blade 91 extends parallel with and in pressure contact with developer roller 43. Blade 91 contacts roller 43 at about 20 degrees from the vertical toward toner adder roller 45. Also shown in FIG. 3 are metal electrical contact 93 to doctor blade 91, metal electrical contact 95 to toner adder roller 45 and metal electrical contact 97 to developer roller 43. The outer ends 93*a*, 95*a*, 97*a* of the contacts bear against metal contacts in the printer when cartridge 1 is installed and thereby make electrical contact to receive electrical potentials from the printer.

The developing system of cartridge 1 is essentially very similar to that of the Optra brand family of printers sold by the assignee of this invention. As in that family of printers, toner adder roller 45 is a conductive sponge material attached to a steel shaft and developer roller 43 is semiconductive material attached to a steel shaft. When cartridge 1 is installed for operation in a printer, cartridge 1 is oriented generally as shown in FIG. 3 and the horizontal plane containing the lowest surface of toner adder roller 45 is 22.6 mm above the lowest point of hopper 61.

Toner adder roller 45 and developer roller 43 are journaled in the rearward extensions 99*a* and 101*a* (FIG. 4) of the end members 99 and 101 (FIG. 4) of hopper 61. Agitator 65 has a bent portion 65*aa* to become parallel to extension 99*a* where it is pivoted to extension 99*a* on pin 103*a*. As paddle 63 rotates, bar 63*a* contacts extension 65*a*, thereby rotating agitator 65 around pin 103*a* upward. Agitator 65 then returns to near rear wall 61*a* under the force of gravity to dislodge toner, which otherwise tends to accumulate on exit surface 61*aaa* (see FIG. 9).

Figure 4:
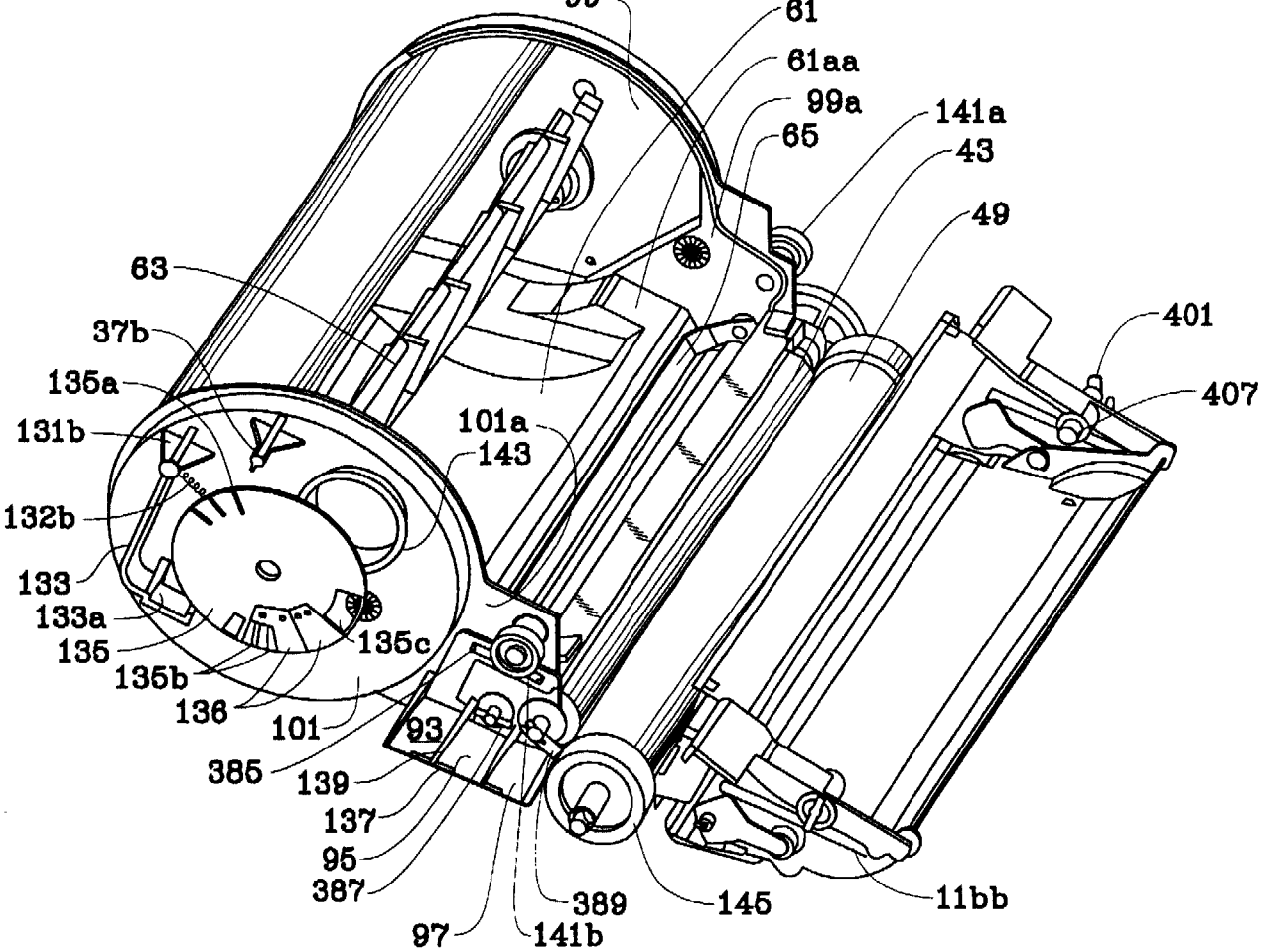
FIG. 4 is a top right rear view of the cartridge with cover elements removed.

FIG. 4 is a top right rear view with cover elements removed showing more fully the end members 99 and 101 of hopper 61 and their extensions 99*a* and 101*a*. Integral with end member 101 is spacer stud 37*b*. Under and to the front of stud 37*b* is spring mounting post 131*b*, which mounts one end of spring 132*b*, the other end of which is mounted on hole 242 (best seen in FIG. 20).

Also integral with end member 101 is perpendicular shield wall 133, which extends downward and rearward to present a barrier to physically protect encoder wheel 135. The bottom portion of wall 133 forms a flat contact surface 133*a* to receive a locating roller from the printer when cartridge 1 is installed. Encoder wheel 135 is linked to paddle 63 through a paddle gear assembly 163 having a torsional yield member (FIG. 5) so as to provide information as to the amount of toner in hopper 61 to the printer on which cartridge 1 is installed by the sensing of the location of windows 135*a*. Additionally, other windows 135*b* provide other information, while wider window 135*c* provides a home location reference. Light blocking selected labels 136 are located between windows 135*b* and 135*c* and block windows of a series of windows 135*b* to thereby customize information onto wheel 135. The details and operation of encoder wheel 135 are described in U.S. patent application Ser. No. 08/602, 648, filed Feb. 16, 1996, now U.S. Pat. No. 5,634,169, entitled "Multiple Function Encoder Wheel for Cartridges Utilized in an Electrophotographic Output Device" and form no contribution to the invention of this specification.

FIG. 4 also shows electrical contacts 93, 95 and 97 as they are supported by floor 137 which extends perpendicularly from hopper extension 101*a*. Vertical ribs 139 extend from floor 137 between contacts 93, 95 and 97 to strengthen the floor 137.

Mounting roller 141*a* is journaled to hopper extension 99*a* and symmetrical mounting roller 141*b* is mounted to hopper extension 101*a*. Rollers 141*a* and 141*b* contact inside surfaces of the cover of cartridge 1, as will be described. Surfaces 133*a* and 161*a* (FIG. 5) of hopper 61 rests on rollers in the printer as will be further described.

Hopper end member 101 has an opening receiving a closely-fitting, resilient, cylindrical plug 143. Prior to installing plug 143, toner is loaded into hopper 61 through the open hole, then plug 143 seals the hole.

Photoconductor roller 49 has at its right end a transfer roller drive gear 145, which drives a roller in the printer when cartridge 1 is installed in the printer.

Figure 5:
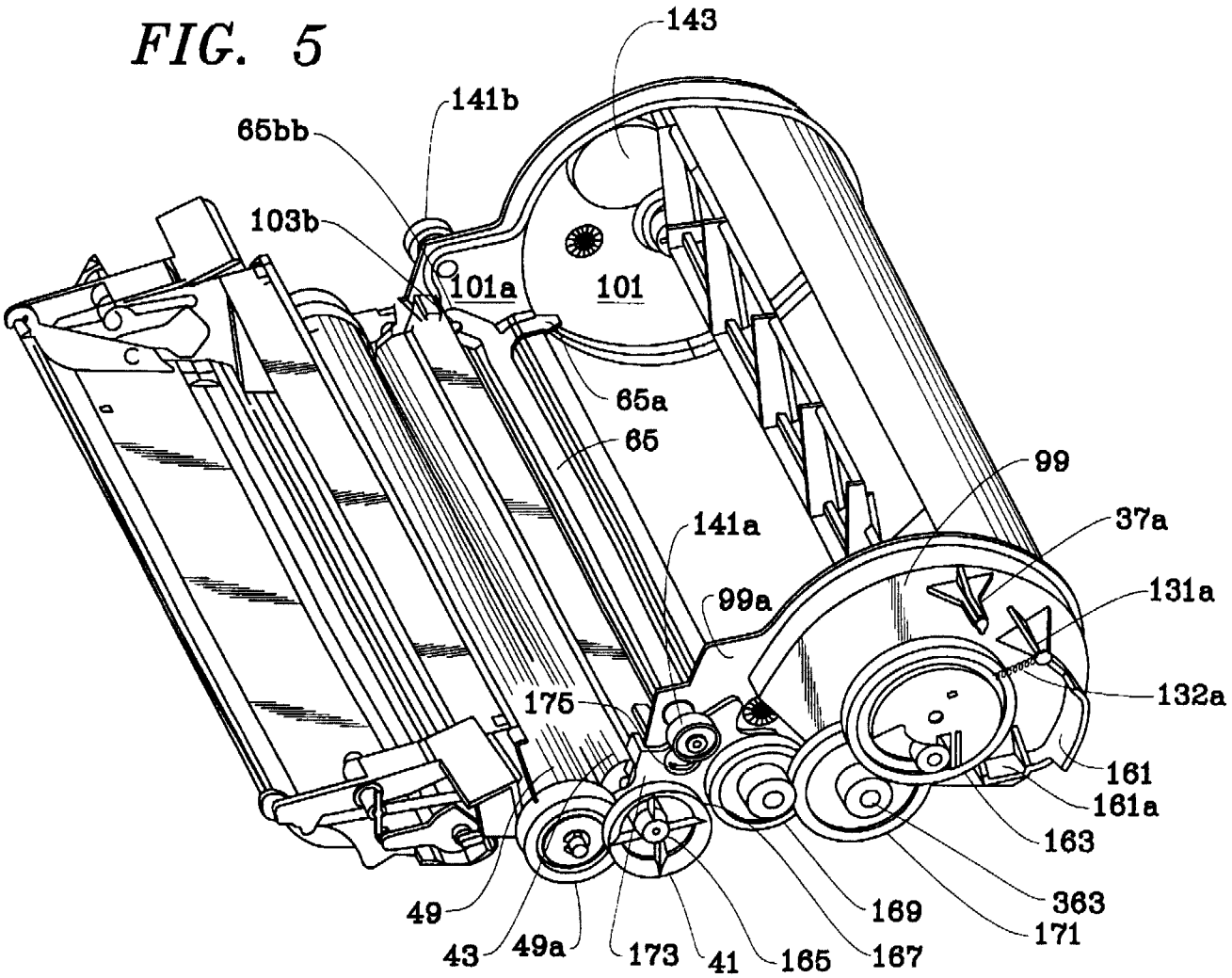
FIG. 5 is a top left rear view of the cartridge with cover elements removed.

FIG. 5 is a top left rear view with cover elements removed showing more fully the outside of members 99 and 99*a* of hopper 61. Integral with end member 99 is spacer stud 37*a*. Under and to the front of stud 37*a* is spring mounting post 131*a*, which mounts one end of spring 132*a*, the other end of which is mounted in a hole in member 431 (FIG. 19), which is an inner extension of cover 33 (FIG. 2).

Also integral with end member 99 is perpendicular shield wall 161, which extends downward and rearward to a barrier to physically protect torsional paddle gear assembly 163. The bottom portion of wall 161 forms a flat contact surface 161*a* to receive a locating roller from the printer when cartridge 1 is installed. The details of paddle gear assembly 163 are not part of this invention and are more fully disclosed in the above-mentioned patent application Ser. No. 08/602,648, now U.S. Pat. No. 5,634,169.

Gear 49*a*, integral with the end of photoconductor drum 49, receives power from a meshing gear in the printer when cartridge 1 is installed in the printer. Coupler 41 is integral with developer roller 43 and drives idler gear 165, which drives toner adder roller 45 (FIG. 3) by being meshed with gear 167, which is integral with toner adder roller 45. Coupler 41 receives power from a driver in the printer which is separate from the drive to drum 49, although preferably from a single motor in the printer.

Gear 167 drives the large gear of compound gear 169. Gear 169 drives the large gear of compound gear 171, and gear 171 drives paddle gear assembly 163. A gear plate 173, mounting gears 165 and 169, is mounted on hopper extension 99*a* by mounting screw 175.

FIG. 5 shows the end of agitator 65 opposite that shown in FIG. 3. That end has a bent portion 65*bb* to become parallel to extension 101*a* of end member 101*a* when it is pivoted to extension on a pin 103*b*.

Figure 6:
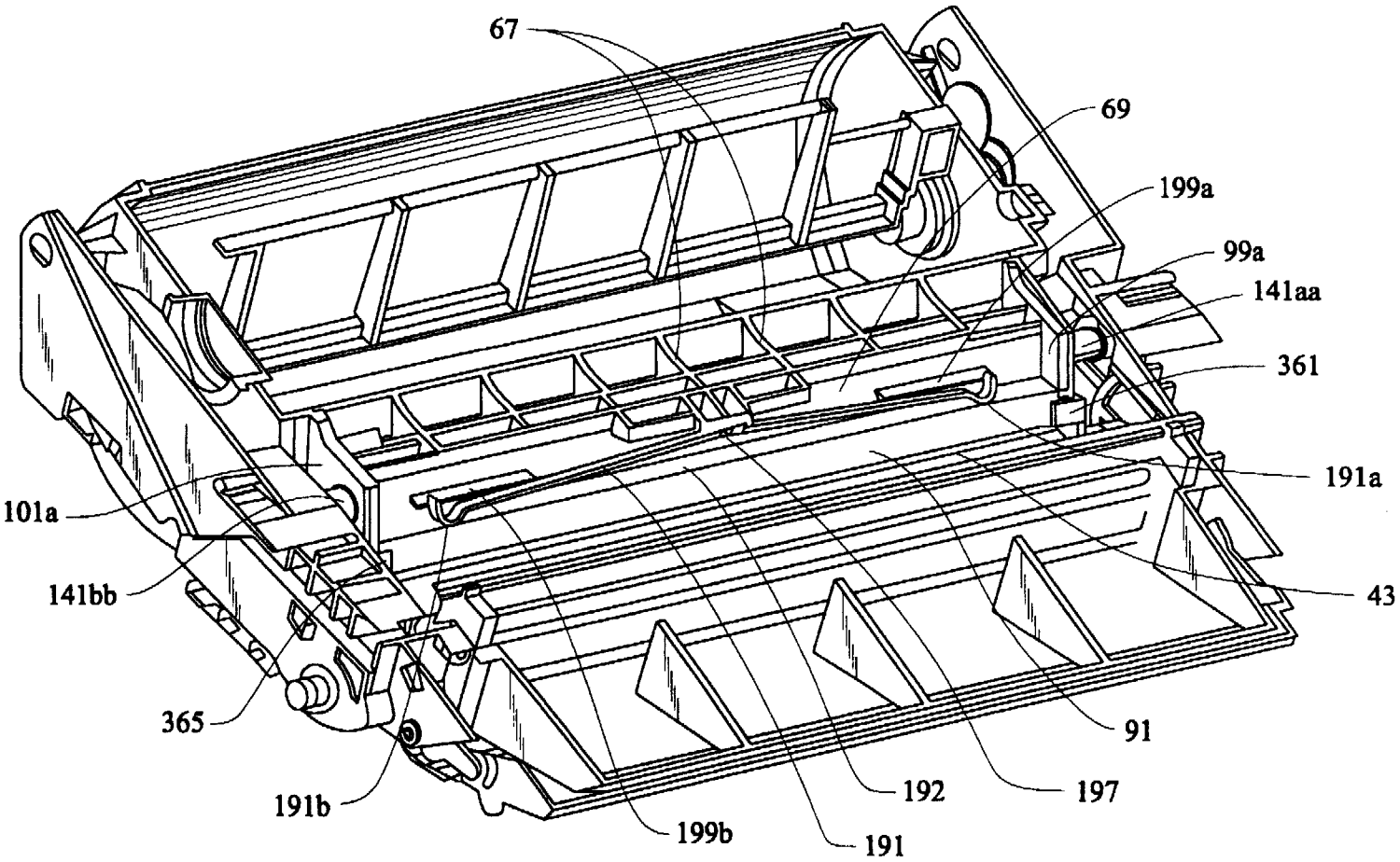
FIG. 6 is a top right rear view of the cartridge sectioned similarly to the sectioning of FIG. 2.

Continuing the detailed description of the cartridge incorporating a preferred embodiment of the present invention, FIG. 6 is a top right rear view sectioned near the top similar to the sectioning of FIG. 2. FIG. 6 illustrates more clearly the mounting of doctor blade 91 mounted to press on developer roller 43 under the bias of leaf spring 191. Blade 91 is located on the left rear by tab 361 (best seen in FIG. 14), and on the rear by extension 196*a* (FIG. 12) of hopper end member 99 which form front and back barriers for holding the left side of doctor blade 91. Similarly, on the right side, two surfaces extending from extension 101*a*, including a rear extension 365 (best seen in FIG. 13) and a front extension 366 (FIG. 13) form front and back holding the right side of doctor blade 91, symmetric to the cage holding the left side of doctor blade 91. The top of blade 91 is held by spring 191. An adhesive tape 192 across the top of the doctor blade 91 bridges over the adjoining horizontal edge of wall 69 (FIG. 2) for sealing, as is conventional.

Spring 191 has blunt ends 191*a* and 191*b*, spaced from the center, which contact blade 91 to bias it downward on to developer roller 43. A central ledge 197, integral with ribs 67, forms a cavity receiving the center of spring 191. Horizontal ledges 199*a* and 199*b*, opposite central parts of spring 191, formed integral with ribs 67, are horizontal barriers to prevent spring 191 from moving toward the front. Preferably, so as to permit rough handling of cartridge 1 which might occur during shipment, solid upper stop members (not shown) are attached by double sided adhesive on each side between ledges 199*a* and 199*b* and the sides 99*a* and 101*a*, respectively. These are spaced 0.18 mm above the top of blade 91 and, therefore, contact blade 91 only during rough handling.

FIG. 6 also illustrates posts 141*aa* and 141*bb*, which are molded as extensions of members 99*a* and 101*a*, respectively, and supporting mounting rollers 141*a* and 141*b*, respectively (FIG. 5).

Figure 7:
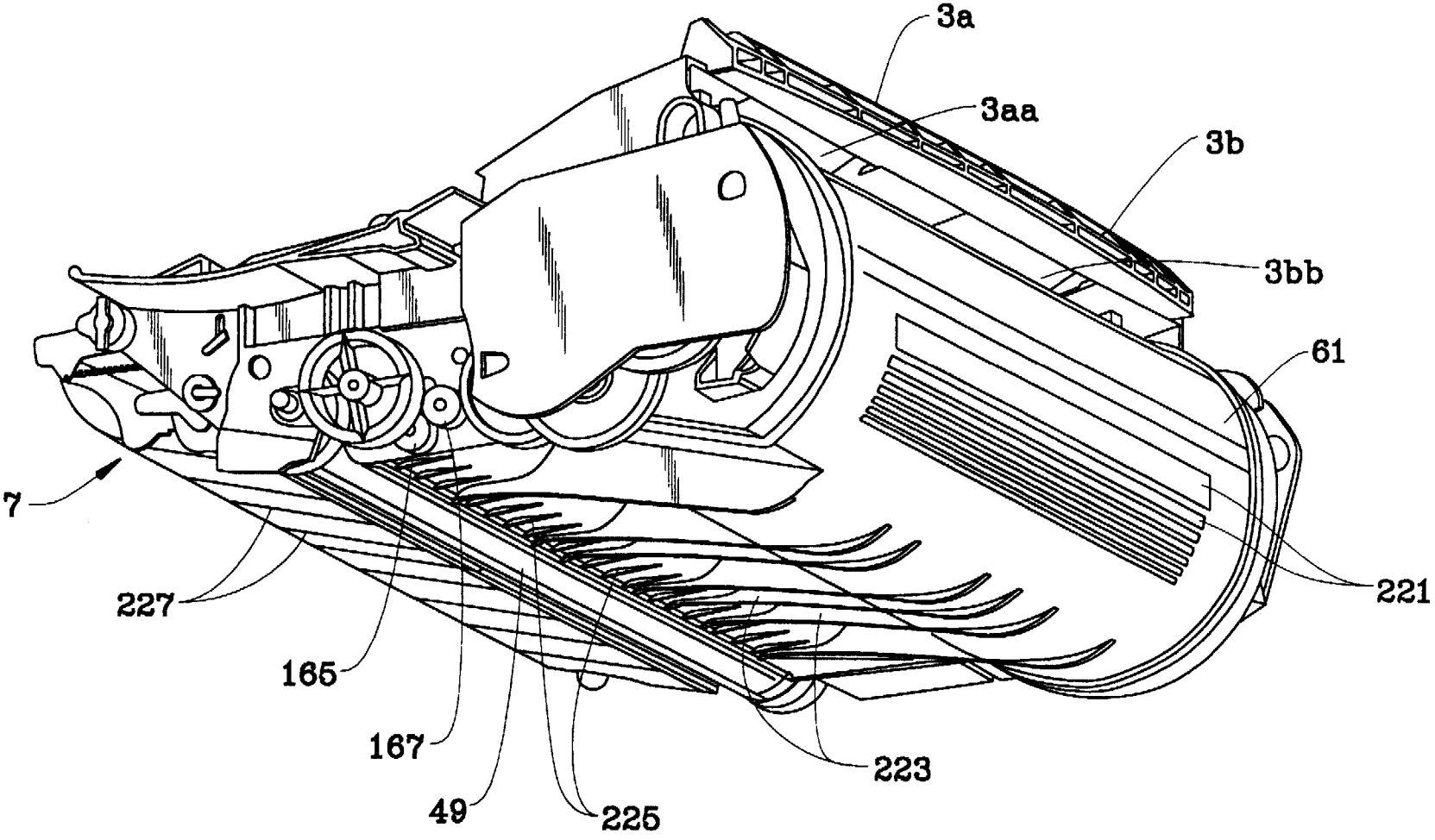
FIG. 7 is a bottom left front view of the cartridge.

FIG. 7 is a bottom left front depiction of cartridge 1 viewed externally. A series of horizontal depressions 221 along the back of hopper 61 provide a roughened surface for thumbs when fingers grasp the cartridge through opening 3*aa* and 3*bb*. A series of relatively long vertical ribs 223 integral with the bottom of hopper 61 serve as paper and other media guides, while a series of shorter ribs 225, located rearward of the start of ribs 223 and between ribs 223, prevent media snags as media encounter photoconductor drum 49, located immediately after ribs 223 and 225. Past drum 49, media encounter further media guide ribs 227 located on the bottom of shutter 7. FIG. 7 also affords a clear view of idler gear 165 and gear 167.

Figure 8:
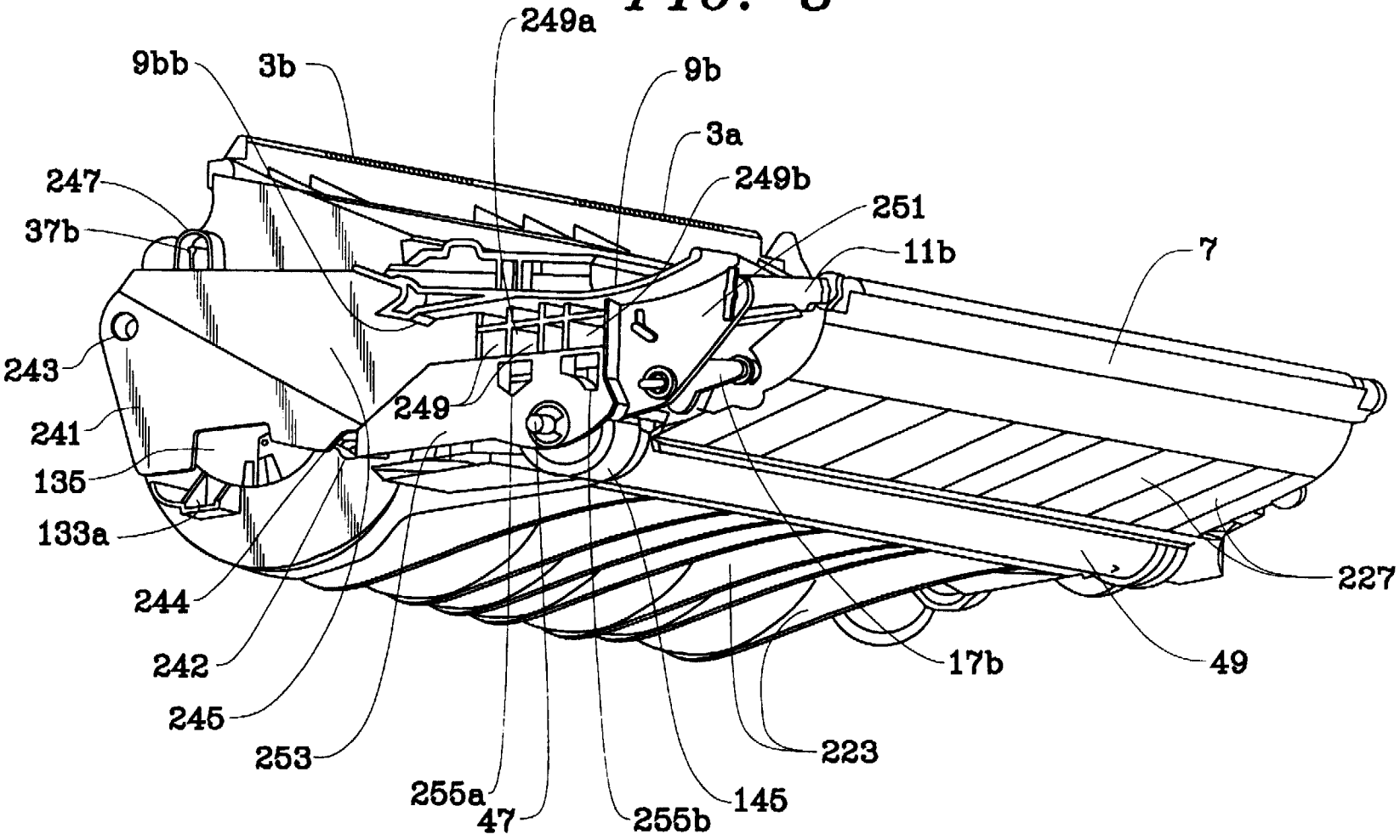
FIG. 8 is a bottom right rear view of the cartridge.

FIG. 8 is a bottom right rear depiction of cartridge 1 viewed externally. This shows the full right guide wing 9*b* with enlarged front part 9*bb*. FIG. 8 shows the right cover elements which were deleted in FIG. 6. A front lower cover section 241 is over much of the encoder wheel 135 and has an access hole 243 for ease of assembly and has an access opening 244 (best seen in FIG. 20). Cover section 241 is stepped outward a small amount to provide room for spring 132*b* (FIG. 20) to extend between post 131*b* (FIG. 4) and hole 242 (best seen in FIG. 20). Generally, above and forward of and integral with cover section 241 is cover section 245, which is over the remaining upper front of cartridge 1. Section 245 has a U-shaped housing 247 at its top which traps spacer stud 37*b*. In the rearward part of section 245 opposite the area above photoconductor drum 49, are located rectangular channels 249 with the second rectangular channel 249*a* and the last rectangular channel 249*b* being open to pass air for cooling photoconductor drum 49 during operation of cartridge 1.

The far rear portion 251 of this particular embodiment of the invention herein described mounts links 11*b* and 17b to shutter 7. A bottom section 253 of the cover located under and forward of passages 249*a* and 249*b* mounts the shaft 47 of photoconductor drum 49 and has two upper symmetrical vent holes 255*a* and 255*b* to pass air for cooling drum 49.

FIG. 9 is a front right perspective view of the molded plastic member housing 271 which forms the central portion and central extension of hopper 61 with end member 99 attached and agitator 65 installed. It is seen to form a cylindrical chamber with an exit opening formed between wall 69 and wall 61*a*. An inset 273 at the bottom rear of hopper 61 provides space for rollers in the printer. As best seen in FIG. 2, paddle bar 63*a* has an inset for left section 63*aa* to clear inset 273.

Figure 12:
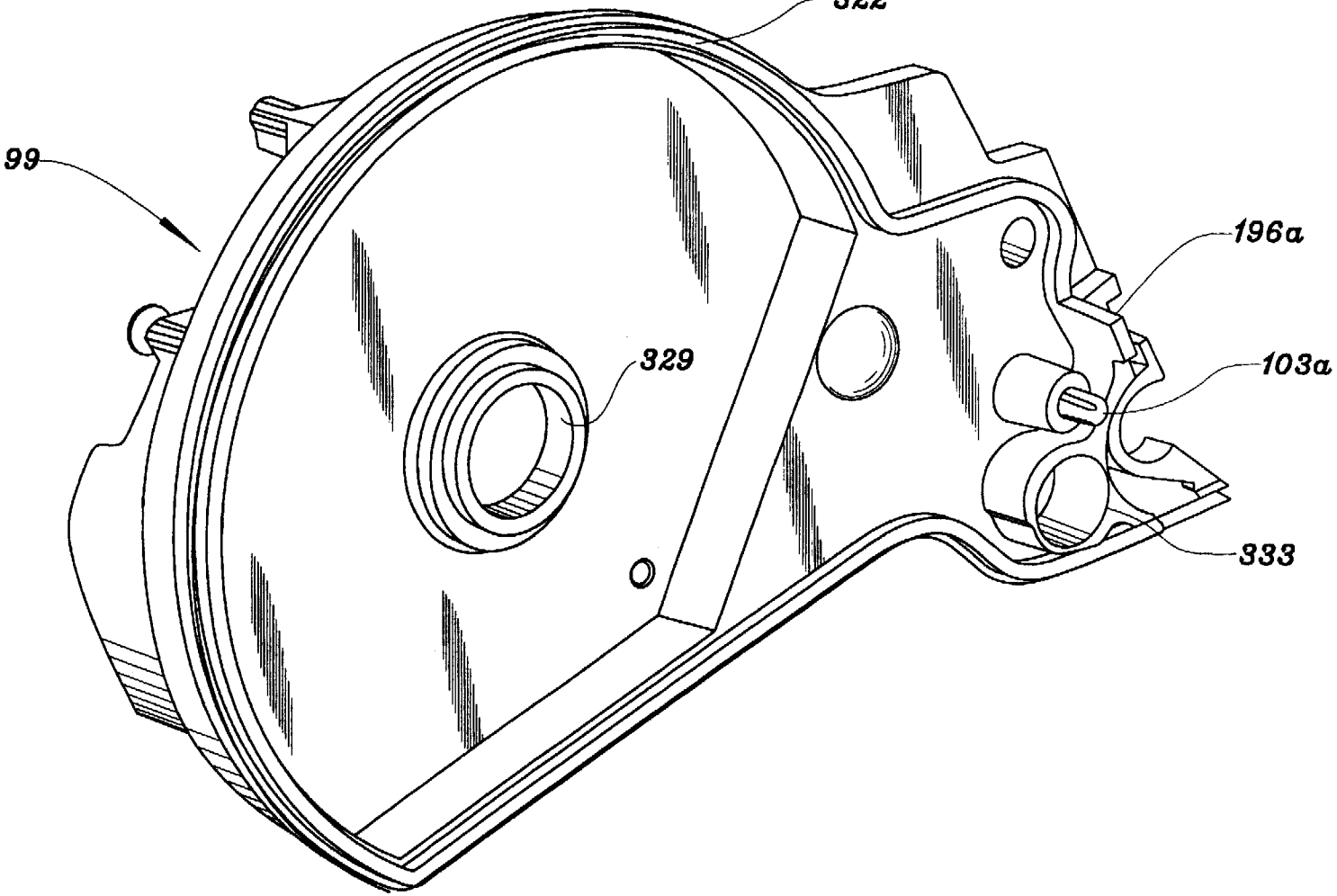
FIG. 12 is a perspective view showing the inside one end member of the hopper.
Figure 13:
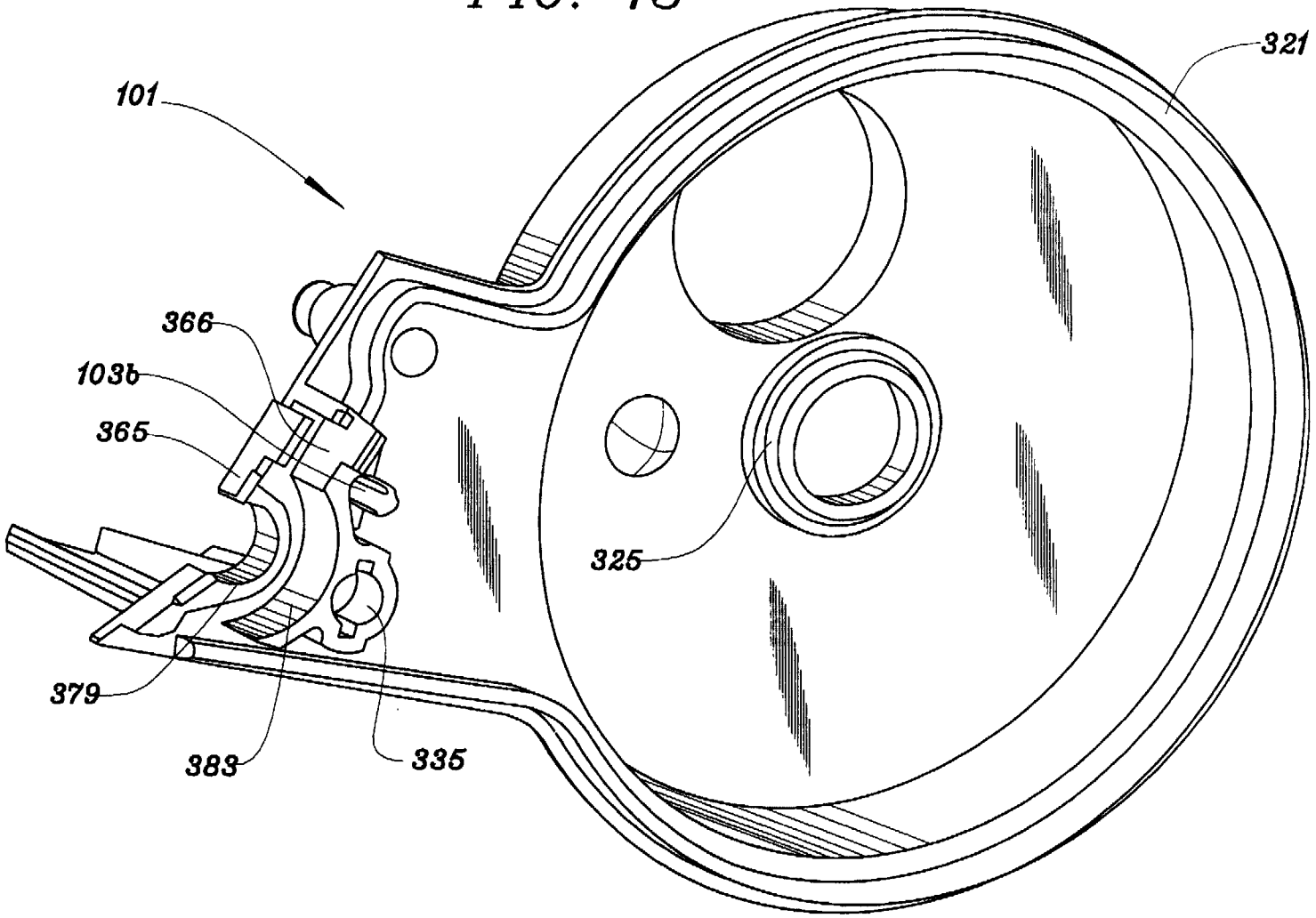
FIG. 13 is a perspective view showing the inside of the other end member of the hopper.

Member 271 has a slot 275 around its right side. A directly similar slot is around the left side. End member 101 has a mating ridge 321 (FIG. 13). During manufacture slot 275 is mated with ridge 321 in end member 101 and the two are welded together with ultrasonically created heat. Member 99 is welded to the left side of member 271 in the same manner with ridge 322 (FIG. 12) inserted in a mating slot (not shown) on the left side of member 271.

A notch 277 above agitator extension 65*a* allows for sufficient rotation of agitator 65 to allow paddle arm 63*a* to pass beyond extension 65*a* while preventing a full turn-over of agitator 65.

Developer Assembly

The housing 271 and its attached end members 99 and 101, form toner hopper 61. Extension 101*a*journals toner adder roller 45 and developer roller 43. Gear plate 173, which is attached to extension 99*a* by screw 175, journals the opposite ends of toner adder roller 45 and developer roller 43. Accordingly, a single unitary assembly is formed of the hopper 61 rearward to and including developer roller 43.

Photoconductor and Cover Assembly

Front cover 25 grips 3*a*, 3*b*, left outer cover 33, rear wall 31, (FIG. 1) right cover sections 241, 245, and 251, (FIG. 8) wings 9*a*, 9*b* and cleaning chamber 27 are a single molded part. Photoconductor 49 is journaled in this part with its shaft 47 extending past the covers on opposite sides. Shutter 7 is movably supported to left cover 31 and right rear cover 251. Accordingly, a single unitary assembly is formed of the cover members, the photoconductor drum 49 and the shutter 7.

In use, springs 132*a* and 132*b* pull the developer roller 43 against the photoconductor drum 49 at a predetermined tension. When cartridge 1 is picked up, the developer assembly and the photoconductor and cover assembly rotate under gravity until stud 37*a* (FIG. 1) contacts housing 35 and stud 37*b* (FIG. 8) contacts housing 247, thereby holding the two assemblies together.

Lower Shutter as Heat Barrier

Lower shutter 7, when open, covers all of the lower surface of the cleaner chamber. The material of shutter 7 is polycarbonate, a material which deflects heat from the fixing operation which occurs after paper is moved rearward from contact with the photoconductive drum 49. The material of the body of the photoconductor and cover assembly, the hopper 61, end members 99 and 101, and shutter 5 are polystyrene which is lower in cost than polycarbonate would be. The added cost of shutter 7 being polycarbonate is justified by shutter 7 providing heat protection to the cleaner 27 which allows that member to be polystyrene.

Agitator Bar System

The toner of cartridge 1 is monocomponent, which can become stagnant and cohesive when left undisturbed for a time. This stagnation and settling of toner may be aggravated by the slight vibrations generated by the printer motor and gear train in a laser printer.

Failure to deliver toner from wall 61*a* via sloped exit surface 61*aaa* is the consequence of the settling, stagnation, and cohesive nature of the monocomponent toner in hopper 61. The angle of repose of the settled toner (i.e., the angle of tilt of a surface on which the settled toner rests before it "falls" under its own weight) can reach or exceed 90 degrees. The exiting surface 61*aaa* is tilted upward at approximately 50 degrees from vertical during operation (angle A, FIG. 9), allowing the toner to stagnate into a pile that does not reach the toner adder roller 45. This leads to premature failure to print, termed "starvation, " as would result using an empty cartridge. Experimentally, as much as 230 grams of the 465 gram capacity of hopper 61 of toner have been found in the hopper 61 of a cartridge 1 when starvation has occurred due to existence of a stagnant pile of toner preventing toner delivery to toner adder roller 45.

Agitator bar 65 overcomes toner stagnation and failure to deliver toner to toner adder roller 45. The primary function of agitator bar 65 is to prevent toner stagnation and to deliver toner from the entrance of the developer sump to the toner adder roller thus preventing premature failure to print.

As the hopper paddle 63 rotates counter-clockwise (FIG. 3), it reaches a point in its rotation where it begins to contact extension 65*a* and lift agitator bar 65. Paddle 63 continues to lift agitator bar 65 until it loses engagement with extension 65*a*. At this point, the agitator bar 65 falls back via gravity to the resting position, carrying toner from the entry of the developer chamber to the toner adder roller. (Although not useful on the disclosed embodiment, an alternative is a pad on extension 65*a* or on upper wall 61*aa* which will cushion the fall. Such a pad would also serve as a spacer to control the position of the agitator in the down position and eliminate tab 65*b*).

At the top of its travel the agitator bar 65 is out of the way of the main sump paddle 63 and approaches a notch 277 in the hopper housing 271 (FIG. 9). Notch 277 provides space for the agitator bar 65 to clear the end of hopper paddle 63, and prevents overtravel of the agitator arm 65, which could cause locking into an up position when the cartridge is shipped, stored, or handled outside of the machine.

In the up position, the agitator bar 65 forms a nearly vertical wall over hopper wall 61*a*. The initial opening above wall 61*a* is about 26.7 mm, while the height of bar 65 facing that opening is 7 mm. This allows room for toner from the main sump to flow between the agitator 65 and sloped wall 61*aaa*. It also serves as a temporary barrier to prevent the delivery of excessive amounts of toner from the hopper 61 to the toner adder roller 45. As the agitator bar 65 falls to its resting position, both newly delivered toner and any stagnant toner resting on wall 61*aaa* are pushed toward the toner adder roll 45. The motion of the agitator 65 also stirs toner in the area above and toward developer roll to doctor blade nip 91, helping to prevent packing and stagnation of toner in this volume.

The agitator 65, preferably can be implemented by stamping (or laser cutting) and can be formed from sheet metal with spring characteristics that maintain agitator shape during assembly and operation. The entire part comprising bar 65, extension 65*a* and bent portions 65*aa* and 65*bb* preferably can be made by stamping out all features in one operation. As envisioned for the preferred embodiment, illustrated herein, bar 65 may have a length approximately equal to the toner adder roller length, which may be, for example, 220 mm; and have an exemplary height of approximately 7 mm; a thickness of 1.3 mm, chosen to give an agitator mass of the entire part stamped of, for example, approximately 20 grams. Since agitator bar 65 is driven by gravity, the mass is chosen to provide a driving force sufficient to push stagnant toner along wall 61*aaa* to toner adding roll 45, but the mass is limited so as not to affect the torque sensing function of the hopper paddle 63.

Hinge segments 65*aa* and 65*bb* and the associated distance from pins 103*a* and 103*b* to agitator bar 65 determine the arc swept by bar 65 as it falls from the up position to the down position. In the present preferred embodiment, pivot distance of 13.5 mm, for example, allows the paddle to sweep from an up position which leaves a gap of 3 mm between the bottom of the bar 65 and the wall 61*aa*, to a down position 3 mm above the toner adder roller 45. With this design, the weight of the paddle is effectively applied to move toner over the distance swept by the arc. A shorter pivot distance would result in insufficient travel to capture and deliver toner; and would require a heavier paddle to exert the same force on the toner over the distance swept through the arc. Pins 103*a* and 103*b* are smaller in diameter (1 mm, for example) than their holes in which they fit in portions 65*aa* and 65*bb* to prevent binding due to toner buildup.

Extension 65*a* is long enough to engage the active segment of paddle 63. Additionally, the length of extension 65*a* is long enough to overlap the active segment of paddle 63 when extension 65*a* first engages the paddle 63 to prevent scraping of the paddle surface. A small radius (0.5 mm, for example) is placed on the bottom tip of extension 65*a* to prevent scraping of paddle 63 as it releases extension 65*a*.

The overall length and elasticity of the agitator 65 allows assembly over pins 103*a* and 103*b* by simply deflecting the part.

Accordingly, this agitator design functions to overcome toner stagnation and to deliver toner from the entry of the hopper 61 to the toner adder roller 45 active area. The agitator 65 and its extensions 65*a*, 65*aa* and 65*bb* are a single part. Agitator bar 65 is driven internally, with no external gearing, cams, or seals as would be required by an externally driven agitator. Thus gear cost and complexity, seals, friction, and toner leaks are eliminated as problem areas. Agitator 65 is activated frequently enough to move toner and prevent stagnation without adding excessive stirring or damage to the toner. This design enhances first-in, first-out toner delivery from hopper 61 to the smaller area containing the toner adder roller 45 by preventing excessive toner delivery in the raised position and discouraging return toner from the area of the toner adder roller 45 to the hopper 61.

Dimensions

With the cartridge installed for operation, the location of the nip of toner adder roller 45 with developer roller 43 is at 105 degrees from vertical. The nip angle of the photoconductor drum 49 to the developer roller 43 is 95 degrees from vertical. As previously stated, the doctor blade nip is at 20 degrees from the vertical.

The length from the bottom of hopper 61 to the horizontal plane coinciding with the edge of top surface 69 near hopper 61 is 61.96 mm, creating an initial opening of about 26.7mm (as indicated previously, bottom surface 61*aa* is at 35.3 mm). Top surface 69 has a slight upward angle to a tallest point of 64.34 mm.

The diameter of toner adder roller 45 is 14 mm and it is located with its circumference 1 mm above the bottom of hopper body 271 immediately below it. The diameter of developer roller 43 is 20.11 mm and it is located with its circumference 2 mm above the bottom of hopper body 271 immediately below it. The length from the bottom of hopper 61 to the horizontal plane coinciding with the bottom of developer roller 43 is 23.7 mm, and the corresponding length to the bottom of the toner adder roller 45 is 22.6 mm. The diameter of photoconductor drum 49 is 30 mm.

The bottom of body 271 under rollers 43 and 45 is at a 6 degree upward angle to provide sufficient room for guide ribs 225 on the outside of body 271.

Installing the Cartridge

Figure 10:
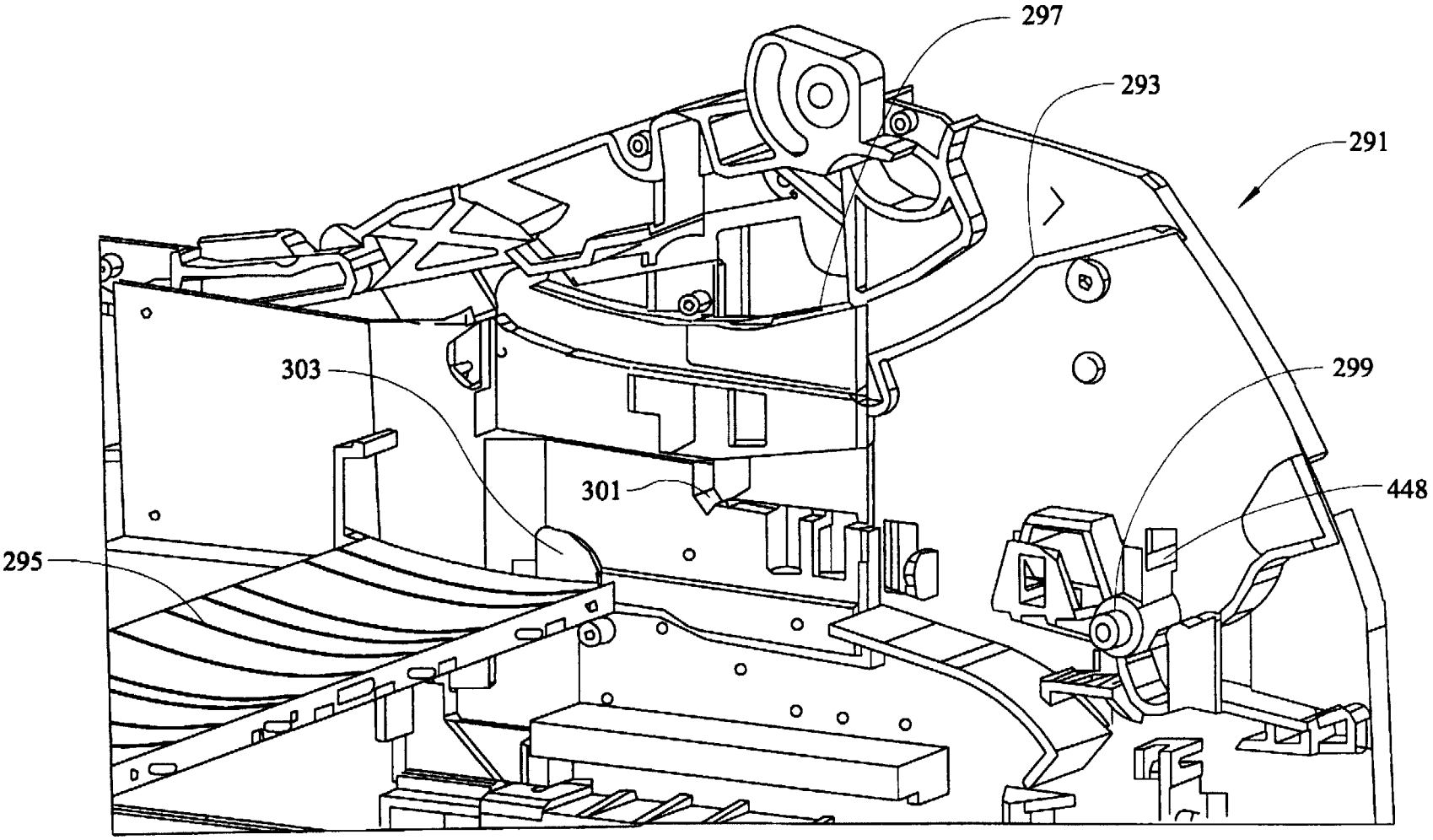
FIG. 10 is a left front view of the inside of a printer in which cartridge 1 is installed.

FIG. 10 is a left front view of the inside of a printer with which the inventive cartridge herein described by way of an exemplary preferred embodiment may be used. The cartridge 1 is installed in a printer 291 (FIG. 10) from the front to a final position well within the printer 291. To achieve this, guide wings 9*a* and 9*b* are initially guided by a lower track 293 over a curved track, which guides cartridge 1 under the laser printhead (not shown) and over paper feed elements 295.

The path is downward, which utilizes gravity while inserting cartridge 1, thereby easing insertion. The guide 293 (and a guide not shown, which is a mirror image of guide 293 on the opposite side of printer 291) has the same curvature as wings 9*a*, 9*b* so that the wings 9*a*, 9*b* can follow guide 293 and its opposite guide.

Upper guide 297 is parallel to guide 293. Guide 297 extends further into the printer than guide 293. A guide (not shown), which is a mirror image of guide 297, is on the opposite side of printer 291. Guide 297 encounters actuator surface 13*bb* early during the insertion of cartridge 1. As cartridge 1 is moved rearward, actuator surface 13*bb* is rotated to open shutter 7 (as is surface 13*aa* rotated by encountering a mirror image of guide 297 on the left side of the printer). This early movement of shutter 7 is very advantageous in that it eliminates the need for space and mechanism which would be required if actuation occurred at the end of insertion of cartridge 1.

Also shown in FIG. 10 is the right reference position roller 299 on which contact surface 133*a* rests when the cartridge is inserted. Contact surface 161*a* will rest on an identical roller (not shown) on the opposite side of printer 291. Rearward of roller 299 is V-block 301, shown more clearly in FIG. 11, and an associated electrical contact 302. Further rearward is an upstanding lug 303, which will contact shutter 7 to hold it open as will be described.

Figure 11:
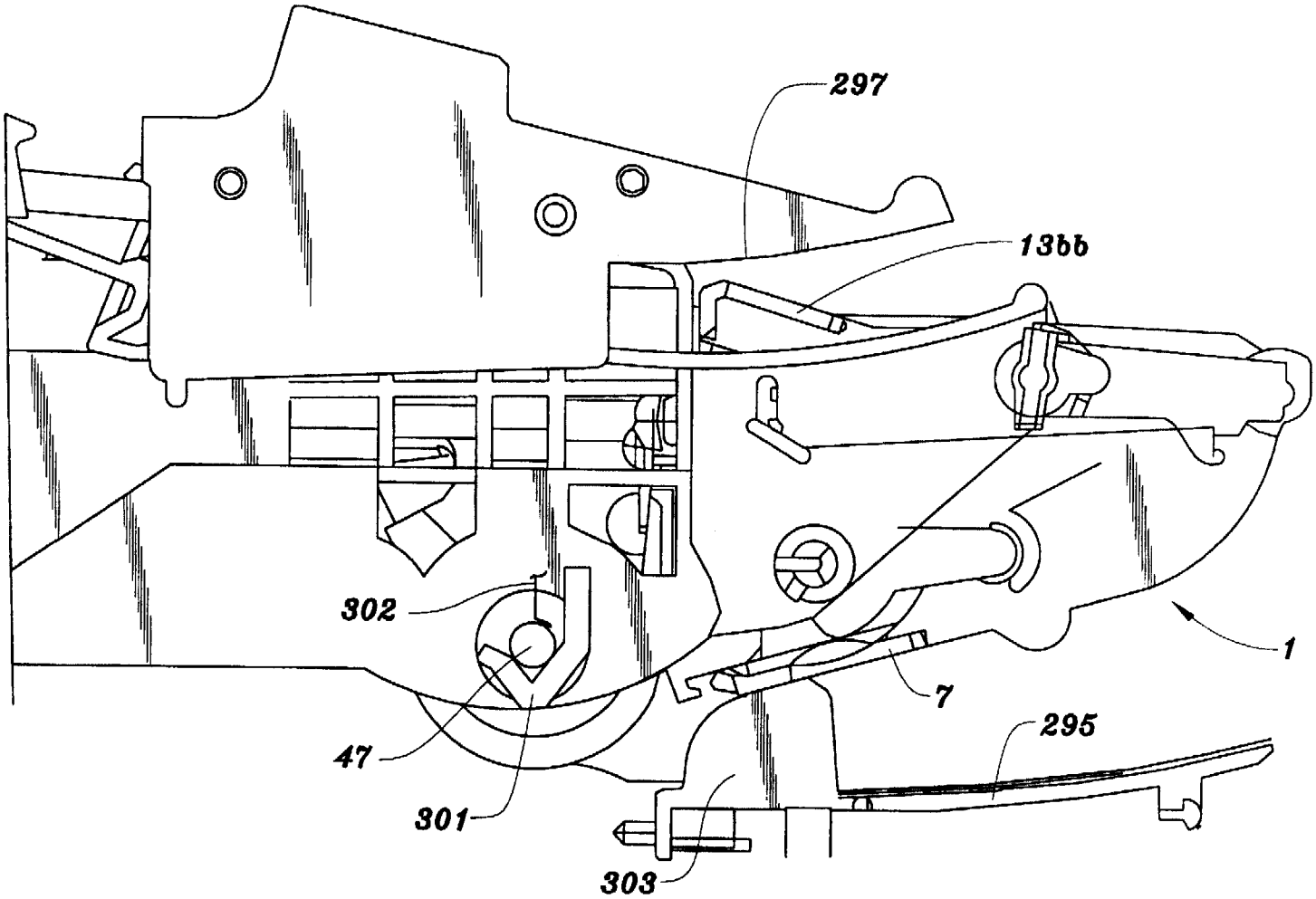
FIG. 11 is a partially sectioned right side view showing more detail of parts shown in FIG. 10 with the cartridge installed.

As cartridge 1 is inserted, wings 9*a*, 9*b* are guided by guides 293 and 297 and the mirror image guide (not shown) on the opposite side of printer 291. As insertion continues, the wings 9*a*, 9*b* fall off the lower guide 293 (and its mirror image guide) and the shaft 47 of photoconductor drum 49 drops into V-block 301 and a mirror image V-block (not shown) on the opposite side of printer 291. A depending thin metal sheet 302 (FIG. 11, shown in side view) is contacted and bent somewhat by shaft 47 as it is guided by V-block 301. This creates a connection for operating potential to shaft 47. When cartridge 1 falls into V-block 301, lug 303 contacts shutter 7 to hold shutter 7 open. Prior to that the longer length of upper guide 297 was sufficient to hold shutter 7 open.

In this final position cartridge 1 is more precisely located with respect to functional elements. Cartridge 1 is held in printer 291 as described below under the heading "Reference Surfaces."

To remove the cartridge, it is grasped by grips 3*a*, 3*b* and pulled sharply upward and forward. Wings 9*a* and 9*b* again enter between guides 293 and 297, and the cartridge can be pulled free.

Manufacture of Cartridge

All molded parts follow the technical dictate (to avoid distortion on cooling) of keeping adjoining surfaces the same thickness. Accordingly, molded studs seen from the rear (shown, for example, in FIG. 13) appear as holes in the part. Circles in the drawings with bowed lines crossing indicate the gate where molten resin was received into the mold (shown, for example, also in FIG. 13).

Assembly of cartridge 1 begins with the joining of hopper body 271 to its end members 99 and 101 with paddle 63 installed. The inside of end member 99 is shown in FIG. 12 and the inside of member 101 is shown in FIG. 13. Both are molded parts of polystyrene resin. Each of the members 99 and 101 is mated to its corresponding side of body 271 (FIG. 9). Ridge 321 of member 101 enters slot 275 on the right edge of member 271. Ridge 322 of member 99 enters slot (not shown) on the left edge of member 271 mating ridge 322. Those parts are held tightly in a fixture and ultrasonically welded, with paddle 63 inserted before the last of the two end members is welded. Then a bushing (not shown) is press fit into the central hole 325 of member 101 around the shaft of paddle 63 and a second bushing (not shown) is similarly press fit around the shaft of paddle 63 in central hole 329.

Agitator bar 65 (FIG. 9) is then flexed and installed by mounting end portion 65*aa* on pin 103*a* and end portion 65*bb* on pin 103*b*.

Toner adder roller 45 with low friction washers on each end is then installed by angling its shaft through hole 333 (FIG. 12) in member 99, straightening, and then moving roller 45 laterally to bring its shaft through a press fit bushing (not shown) in socket 335 in member 101.

Prior to installing toner adder roller 45 and gear plate 173, a sickle-shaped seal member having a semicircular central body (not shown) is installed on each side of the location of developer roller 43. Such a seal is illustrated in IBM Technical Disclosure Bulletin, Vol. 33, No. 3B, August 1990, pp. 29–30, entitled "Toner Seal for Printer." The location of this seal on the right side is labeled surface 383 in FIG. 13. This is essentially standard as putty is first applied on each end of the location for the seal and the ends of the compliant elongated seal are pressed into the putty. The seal has ridges directed slightly toward the center. A seal system such as this is essentially the same as previous cartridges.

Figure 15:
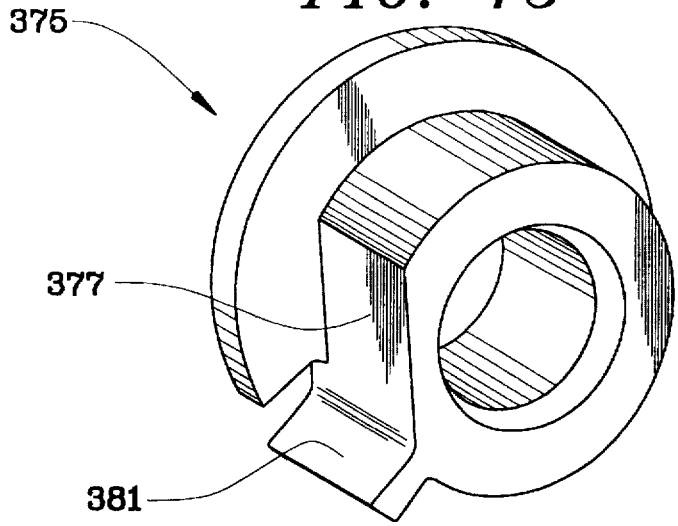
FIG. 15 is a perspective view of a readily removable bushing.

Doctor blade 91 (best seen in FIG. 6) is then installed by bringing it vertically upward behind ridge 365 (FIG. 13) on the right. In the completed cartridge 1 blade 91 is held on the bottom by contact with developer roller 43. Developer roller 43 with low friction washers on each end is installed by positioning the left end of its shaft past end member 99 (FIG. 12) and threading the right end of its shaft through the central hole the bushing 375, shown in FIG. 15.

Figure 14:
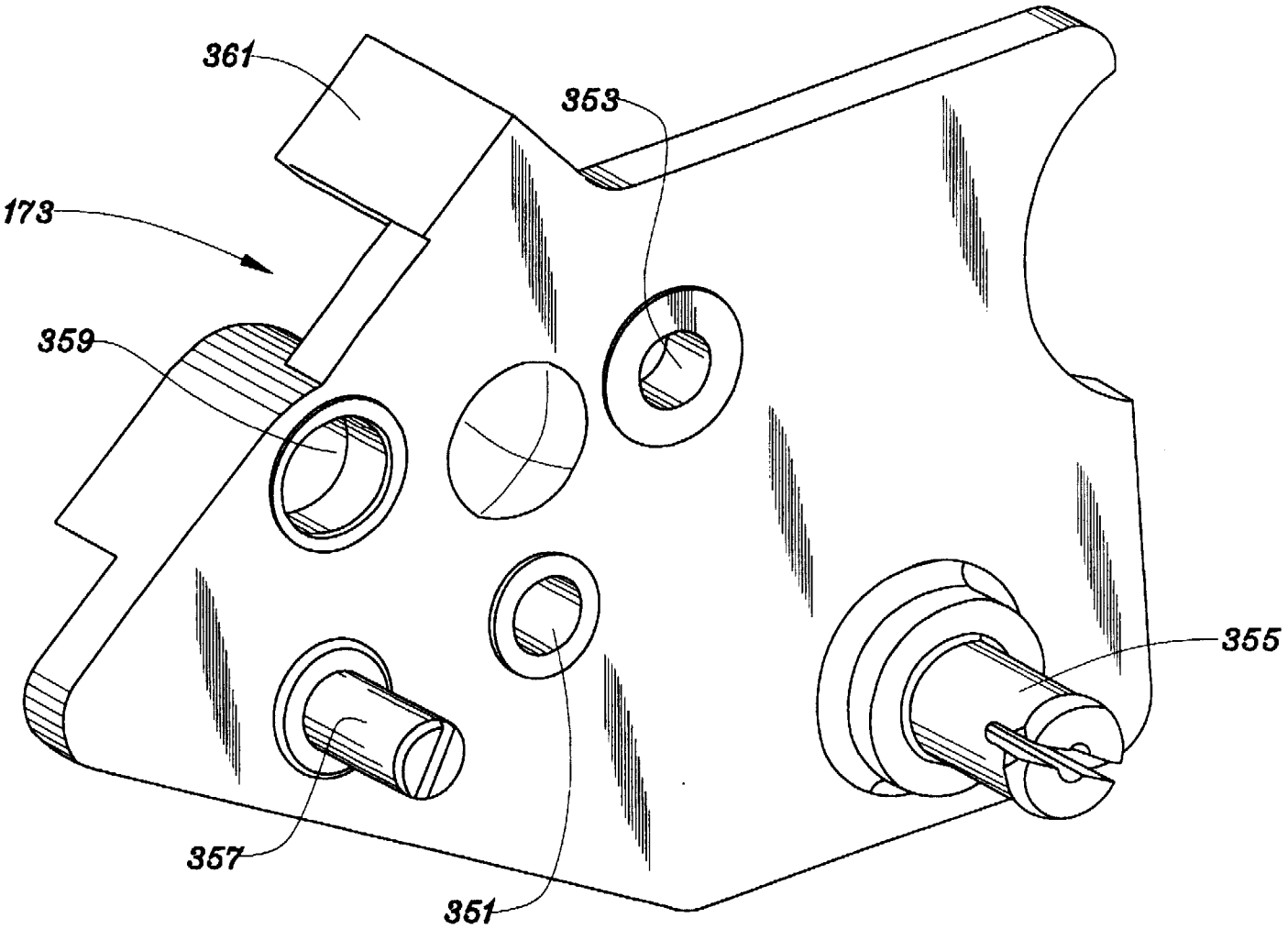
FIG. 14 is a perspective view of the gear plate.

Gear plate 173 is shown alone in FIG. 14. It has a hole 351 to receive of the shaft of toner adder roller 45 and hole 359 for shaft of developer roller 43. A central hole 353 is to receive screw 175 but hole 353 is significantly larger than the shaft of screw 175. Gear plate 173 has a shaft 355, a shaft 357, and a rightwardly extending tab 361.

Gear plate 173 is brought toward member 99 while the shafts of toner adder roller 45 and developer roller 43 are positioned through holes 351 and hole 359 respectively. Gear plate 173 is rotated until tab 361 abuts the edge of doctor blade 91. This serves as a locator for gear plate 173 and doctor blade 91. Screw 175 is then tightened in hole 353 to fix plate 173 in that position.

Gears 169, 165 and 171 are pressed on shafts 355, 357 and 363 (FIG. 5, on member 99). (As is shown in FIG. 14, such shafts have an enlarged head with a gap so as to be yieldable when receiving a press-on force.) A gear 191 is also pressed on the shaft toner adder roller 45. Paddle gear assembly 163 is pressed onto the shaft of paddle 63. These gears and drive coupler 41 are keyed to their shafts by the two having matching "D" cross sections.

Figure 16:
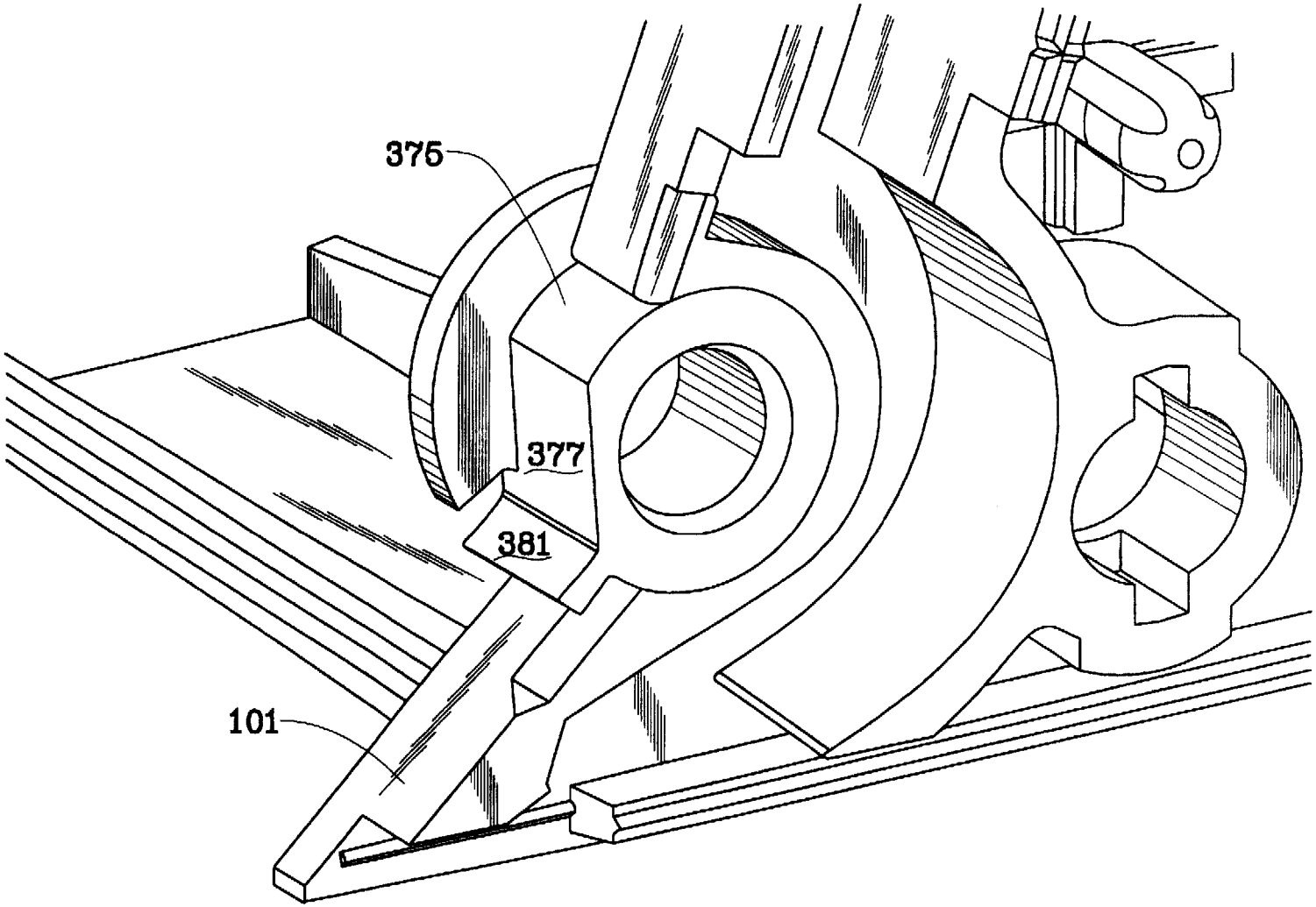
FIG. 16 is a perspective view showing the removable bushing installed.

Bushing 375 has a flat outside segment 377 which permits bushing 375 to enter opening 379 (FIG. 13) in member 101 since opening 379 is circular with an open less-than-one-half circle segment in which bushing 375 can fit at one orientation. Bushing 375 is then rotated in a direction to rotate lower tab 381 downward, which removes the orientation at which bushing 375 can fit through the incomplete segment of 379 and locks bushing 375 into place. Bushing 375 installed is shown in FIG. 16. In operation, developer roller 43 rotates in a direction to rotate tab 381 downward. The advantage of bushing 375 is that it provides for relatively easy installation and change of developer roller 43 in the event that a member requires replacement during subsequent tests.

Drive coupler 41 is then press fit on the left end of the shaft of developer roller 43 using a locating shim to space coupler 41 slightly from cover 31. Mounting rollers **141*a* and 141*b* are previously applied by press fit during completion of the hopper 61. An adhesive tape is applied across the top of doctor blade 91. Spring 191 is then flexed into place to bias doctor blade 91 downward. After toner is installed and leak tested, the previously mentioned upper stop members on each side of ledges 199*a* and 199*b* are applied individually and remain in place, held by their back adhesive layer. Also encoder wheel 135** is installed by press fit.

With rollers 43 and 45 and doctor blade 91 in place, metal contact 93 is inserted between ribs 139. Contact 93 has arrowhead sides to bind into ribs 139, and extends upward and over two posts 385 (FIG. 4) in member **101*a* and extends to a bent end which presses against doctor blade 91. Contacts 95 and 97 similarly have arrowhead sides which dig into ribs 139 and terminate in short bent ends 387, 389, respectively, which press against the shafts of roller 45 and 43**, respectively. Contact grease is added to contacts and shafts.

Figure 17:
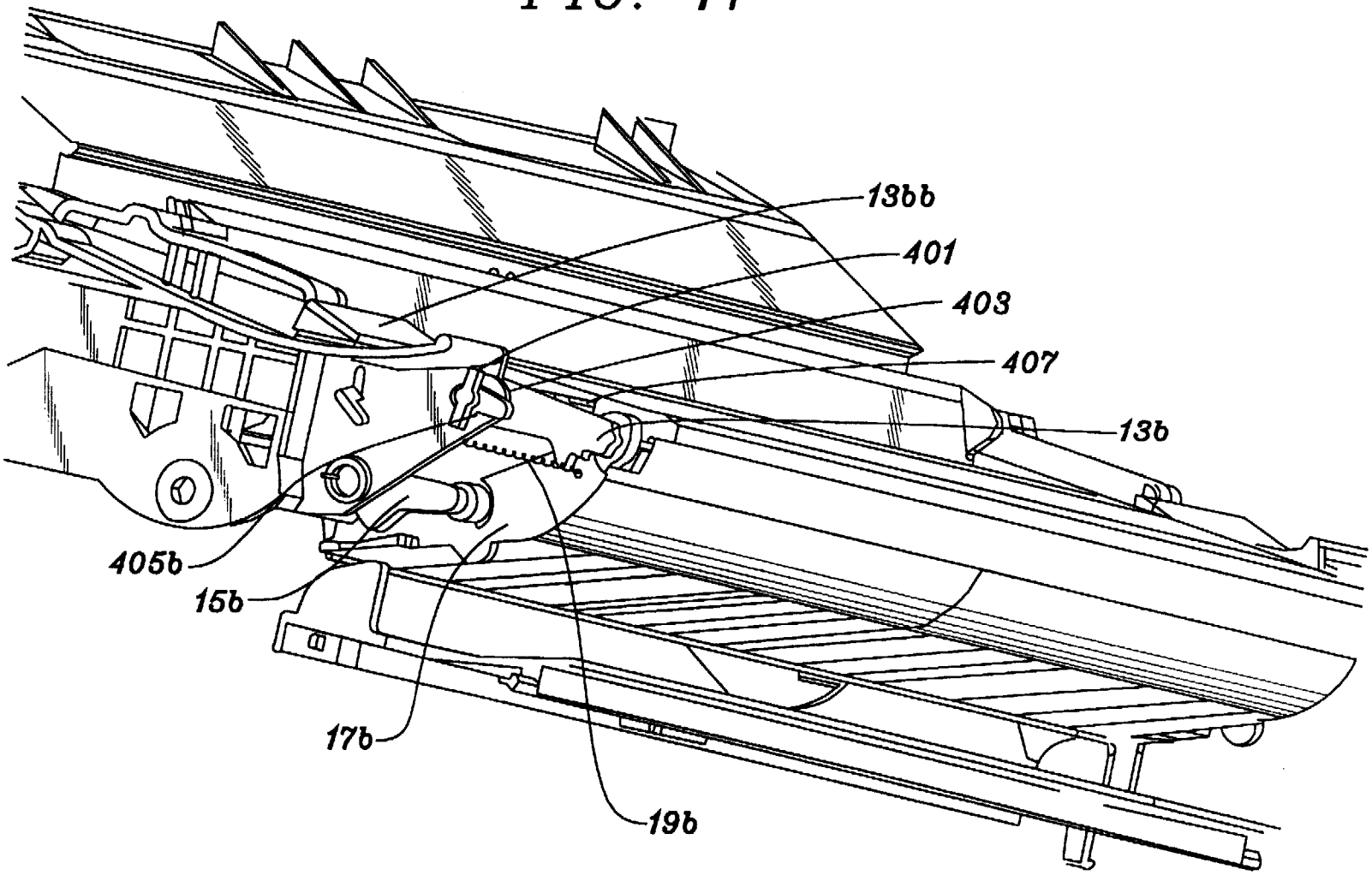
FIG. 17 is a right rear view showing detail of a shutter.

The foregoing all are part of the developer assembly. The photoconductor and cover assembly is separately assembled. The cleaner blade panel **73*a* (see FIG. 3) is installed using screws 77*a* and 77*b*. Link arms 11*a*, 11*b*, 17*a*, 17*b* and 15*a*, 15*b* are assembled in a known manner by studs having extensions which enter matching holes in adjoining arms. The arms are then are rotated to operating positions in which the extensions find no opening and therefore lock the members together while leaving them free to rotate. Links 13*a* to 11*a* and 13*b* to 11*b* are held by a pin 401 with latch, as shown in FIG. 17**.

Pin 401 has a circular flexible arm 403 and arms **11*a* and 11*b* have a matching ledge 405*b* (the ledge on the opposite side not shown). Pin 401 is inserted through the holes of member 13*a* and 11*a* and another pin 401 is inserted through the holes of members 13*b* and 11*b*. The pins 401 are then rotated until their arms 403 flex around ledge 405*b* and the ledge on the opposite side, respectively, and then recover to latch under ledge 405*b* and the ledge on the opposite side, respectively. This holds both four bar linkages in place. Pin 401 has a shaft 407 (best seen in FIG. 4), which extends into a groove (not shown) on each side of cleaner 27** for added stability of each four bar linkage.

Shutter 7 is installed by flexing shutter 7 and locating pins **431*b* and a pin on the opposite side (not shown) on opposite sides and inserting pin 431*b* and the pin on the opposite side in holes in the sides of locator surface 29*a*, 29*b*, respectively. Pin 431*b* has a coil compression spring 433 wrapped around it which is tensioned to bias cover 7** upward.

Figure 19:
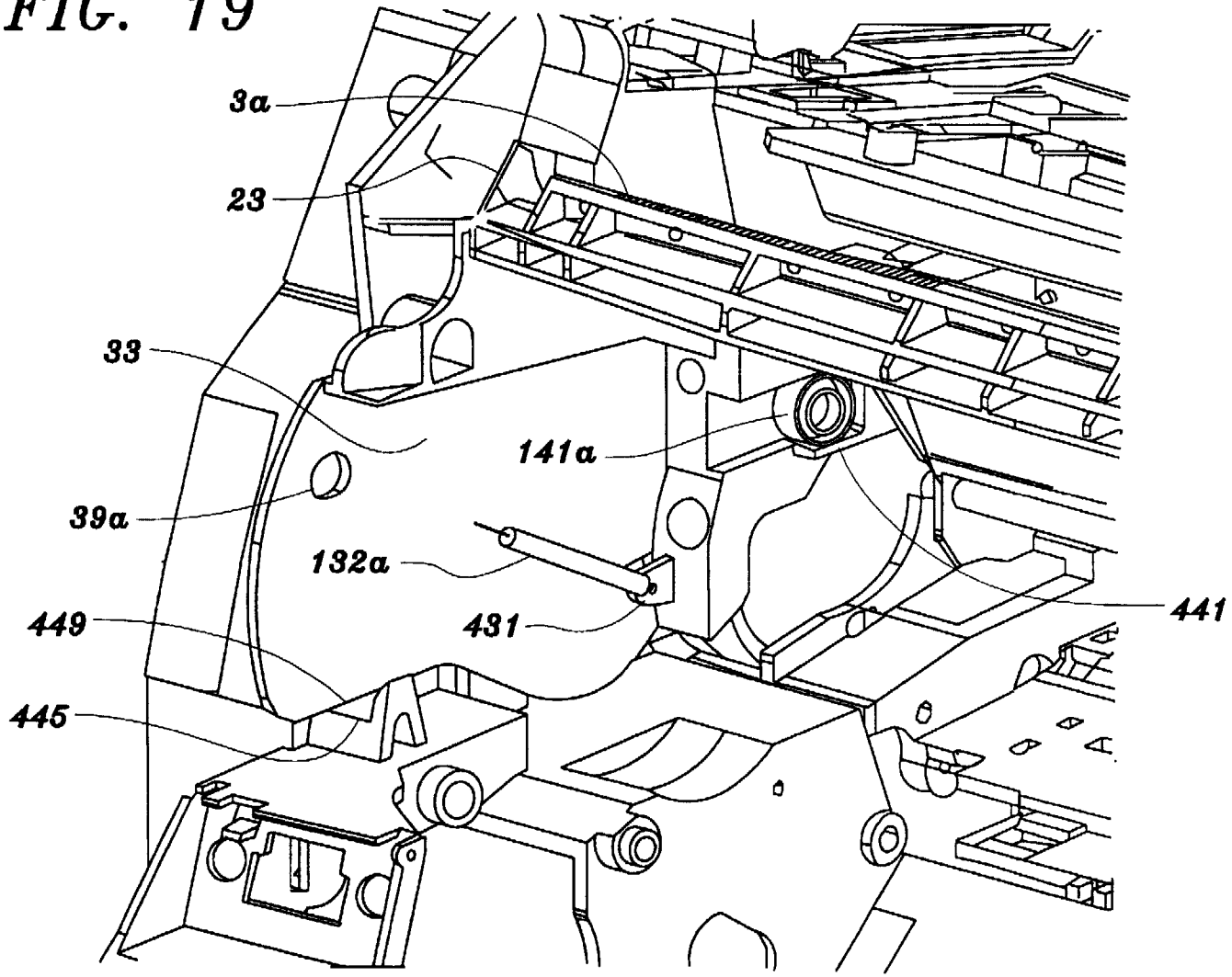
FIG. 19 is a right perspective view showing elements inside the cover of the cartridge.
Figure 20:
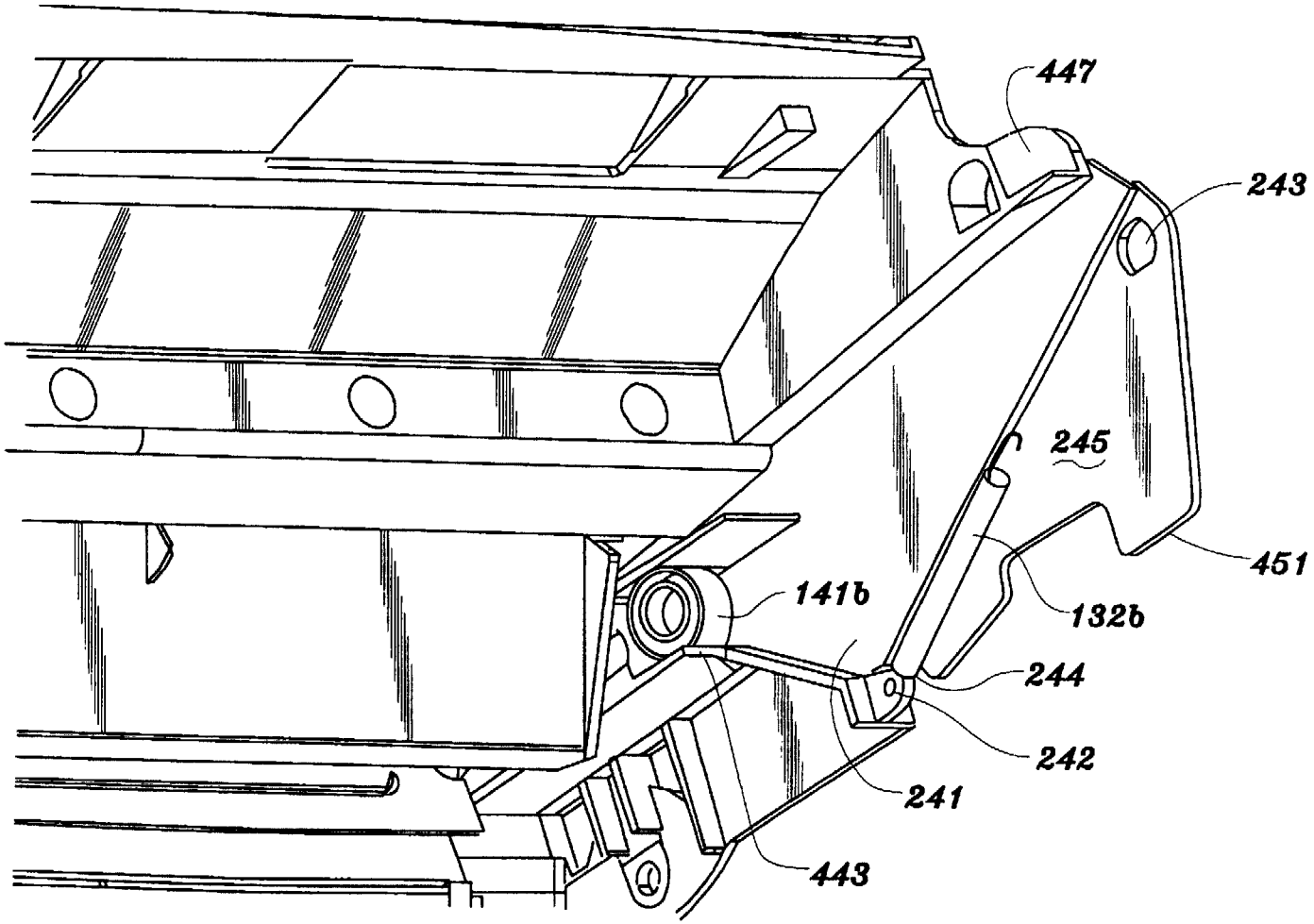
FIG. 20 is a left bottom perspective view showing elements inside the cover of the cartridge.

As best seen in FIG. 19, one end of spring **132*a* is attached through a hole of connector tab 431 of cover 33 on one side and the opposite end of spring 132*a* is temporarily attached to hole 39*a* of cover 33. As seen in FIG. 20, spring 132*b* is attached through a hole of connector tab 242 of cover 241 on one side and the opposite end of spring 132*b* is temporarily attached to hole 243 of cover 241**.

Figure 18:
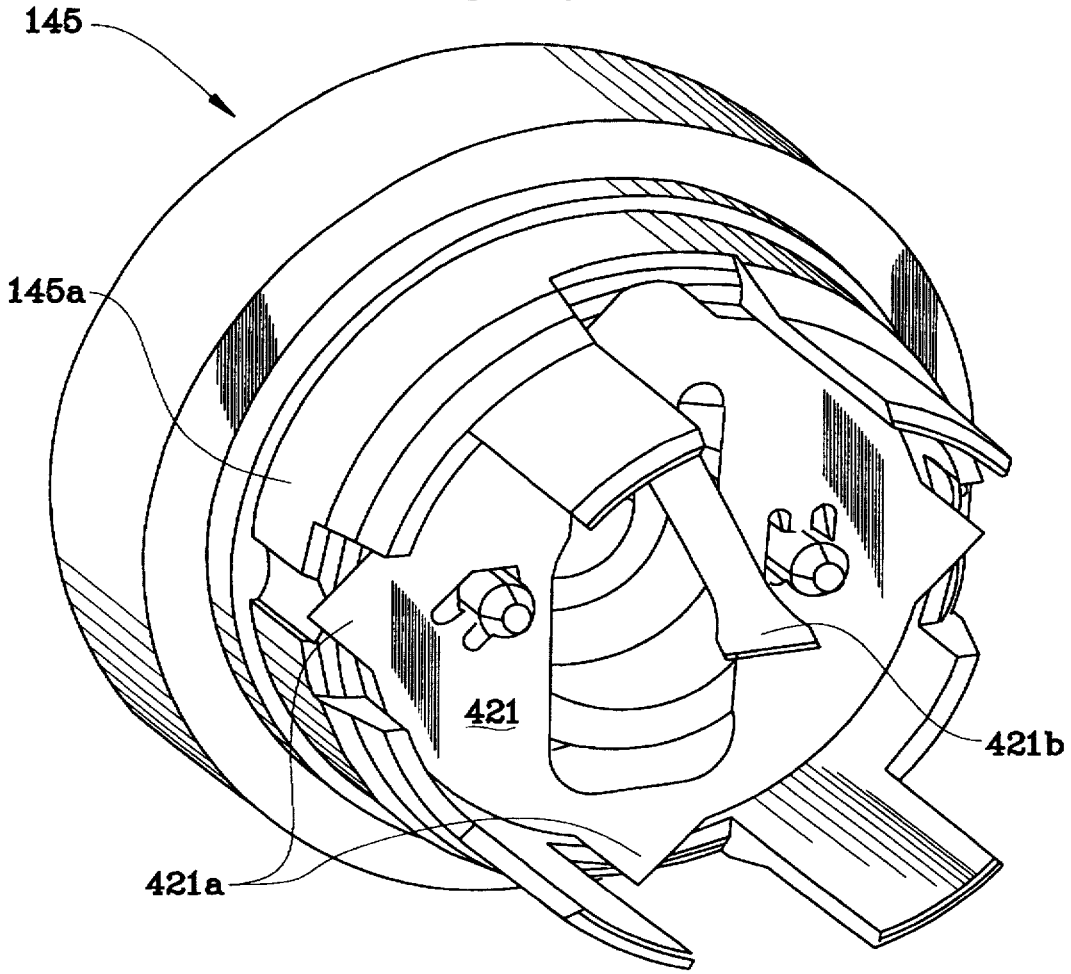
FIG. 18 is a perspective view of an extended hub inserted in the photoconductor drum.

The photoconductor drum 49 is installed into the cleaner housing assembly by placing the drum and the two gears **49*a* and 145 (see FIGS. 4 and 5) in position with a thin washer, (not shown) on the left side and inserting shaft 47 through that assembly and the housings 31 (FIG. 2) and 253 (FIG. 8). Standard E-clips are installed on each end of shaft 47 to hold the drum and shaft from lateral movement. As shown in FIG. 18, an extending hub 145*a* of gear 145, has an internal copper sheet 421 with three sharp points 421*a*. Copper sheet 421 also has an elongated member 421*b* extending to over the central hole. Hub 145*a* is inserted inside drum 49. Points 421*a* dig into the aluminum cylinder which forms the inside of drum 49, creating both physical and electrical connection. Shaft 47 is then threaded through gear 145, drum 49 and then through gear 49*a*. This bends elongated member 421*b* so that it presses against shaft 47** and makes electrical contact.

The developer assembly is then placed before the photoconductor and cover assembly and the two are moved together. Covers 33 and 241, 245 flex outward and then close into the final position. Springs **132*a* and 132*b* are removed from holes 39*a* and 243 and manually attached to studs 131*a* and 131*b* respectively. This completes the cartridge 1**.

It will be readily understood that any joint where toner is contained must be sealed. Immediately inside the bearings of toner paddle 63 and toner adder roller 45 synthetic rubber end seals are located. FIG. 13 shows a socket 335 having upper and lower tabs which receive such a seal, the seal having matching extensions which fit in the tabs to prevent rotation of the seal. The ends of the chamber of cleaner 27 have foam walls with outer adhesive to secure their positioning. As is previously known, other extended joints have a plastic (polyethylene terephthalate) tape with one side carrying pressure sensitive adhesive applied along them by the adhesive. As is also previously known, developer roller 43 is sealed with a tape which is cantilevered up from the bottom of body 271 to be located in front of the roller 43. A second adhesive strip seals the far rear edge of body 271. Such sealing is basically standard and forms no part of this invention.

Toner

In a preferred embodiment cartridge 1 employs monocomponent electrophotographic toner which may be basically conventional. The amount of toner in hopper 61 is limited by pressure impairing print quality and sensing of toner level by toner resistance on paddle 63. When cartridge 1 is in the installed position, a typical top level of toner will be 10 mm above the upper barrier wall 61*aa*. The presence of toner at that typical highest level is indicated in FIG. 9 by surface lines of toner 425, but the toner is shown otherwise as transparent for clarity. The actual toner is, of course, an opaque, dry powder. During use, the toner is depleted to lower levels and it is moved by paddle 63. As is conventional, developer roller 43 applies toner 425 to photoconductor drum 49 to develop electrostatic images on photoconductor drum 49.

Reference Surfaces

FIG. 19 shows just the roller 141*a* of the hopper assembly as finally installed and, therefore, located on a flat surface 441 which is an extension of the cover 33. Similarly, FIG. 20 shows just the roller 141*b* of the hopper assembly as finally installed and therefore located on a flat surface 443 which is an extension of cover 241. Such positioning of an assembly with the photoconductor roller and an assembly with the developer roller for lateral adjustment for rollers is essentially the same as in prior cartridges.

However, in the described embodiment of the present cartridge, cartridge 1 has flat surfaces 133*a* and 161*a* and the printer 291 has the second set of rollers (roller 299, FIG. 10 and its mirror image), on which flat surfaces 133*a* and 161*a*, respectively, rest. In the prior cartridges a second set of rollers was part of the cartridge. As in the prior cartridges the two sets of rollers 141*a*, 141*b*, 299, and the mirror roller image of 299, define a plane of movement to guide the developer roller 43 into the intended contact with photoconductor drum 49.

FIG. 19 shows tab 23, which is an extension of cover 33 and, when the cartridge 1 is installed in a printer as shown in FIG. 19, is generally above a flat surface 445 of the frame of the printer. Similarly, as shown in FIG. 20, a top flat ledge 447 is an extension of cover 241 and, when cartridge 1 is installed in a printer, is above a flat surface (448 of FIG. 10) of the frame of the printer.

A flat bottom surface 449 (FIG. 19) is under tab 23 of cover 33, and a flat bottom surface 451 (FIG. 20) of cover 245 is under ledge 447. Bottom surfaces 449 and 451 are locator surfaces which rest on frame surfaces 445 and 448, respectively.

Figure 21:
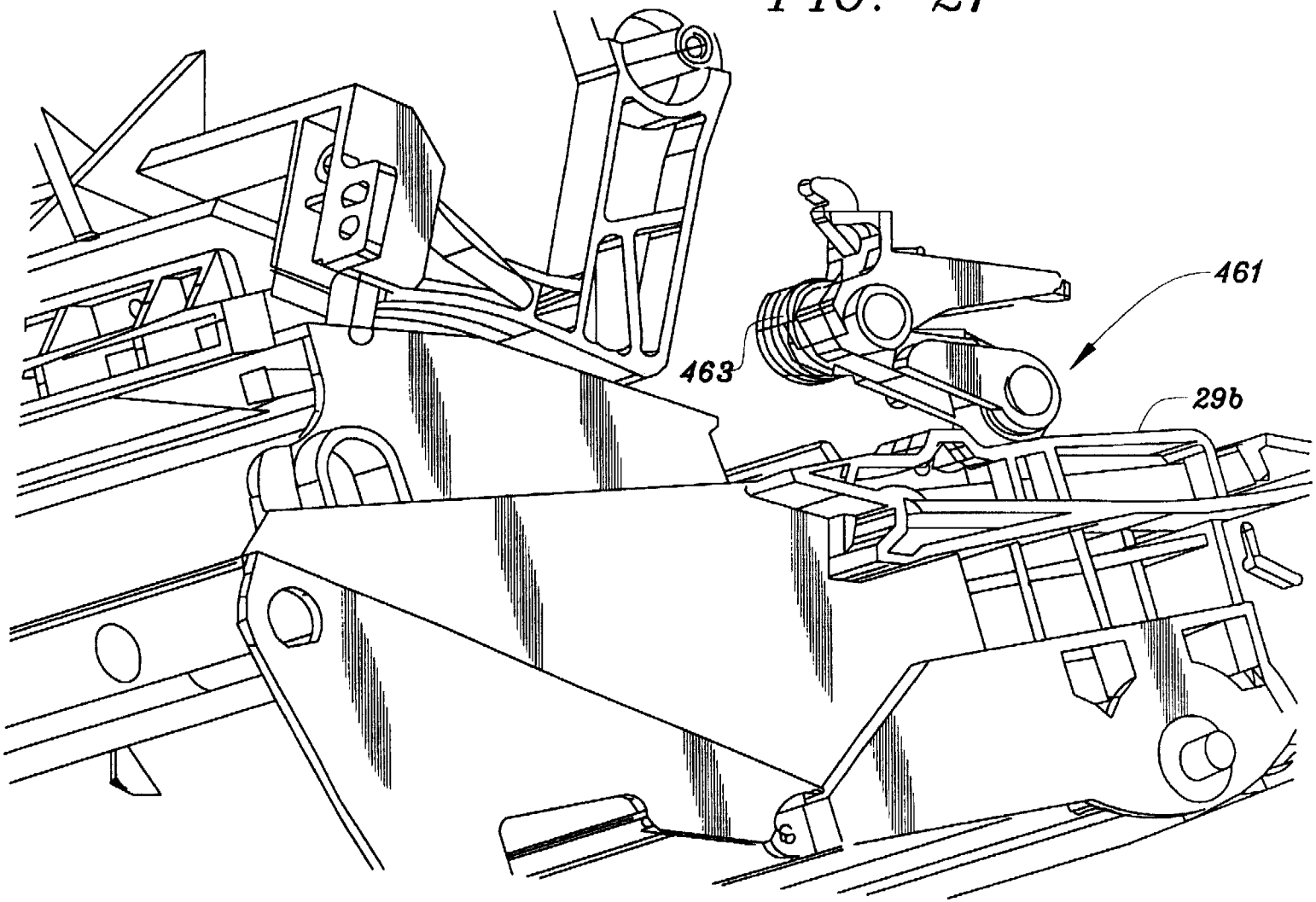
FIG. 21 is a right perspective view showing parts of the cartridge installed in a printer.

FIG. 21 shows the right side of cartridge 1 installed in a printer with emphasis on cantilevered roller 461 pressing down on locator surface 29*b*. A second cantilevered roller (not shown), which is a mirror image of roller 461 exists and presses down on locator surface 29*a*. Roller 461 and its mirror image roller are attached to the frame of the printer. They are firmly biased downward by a coil spring 463 for roller 461 and a mirror image coil spring for the mirror image roller. As the cartridge 1 is inserted in the printer by movement of wing 9*a* in guides 293, 297 and wing 9*b* in corresponding mirror image guides, locator surface 29*b* encounters cantilevered roller 461 and locator surface 29*a* encounters a corresponding mirror image cantilevered roller; and the locator surfaces 29*a*, 29*b* rotate those rollers upward as the cartridge 1 continues to move.

When wing 9*a* falls off of guide 293 and is finally positioned by shaft 47 settling in V-block 301, cantilevered roller 461 fully contacts surface 29*b*, as shown in FIG. 21. When the top cover of the printer is closed, a downwardly positioned leaf spring on the printer cover contacts tab 23 on the left front of cover 33 and a second downwardly positioned spring on the printer cover contacts surface 447 on right cover 241. Such interaction of a cartridge with a printer lid is generally conventional, as illustrated by U.S. Pat. No. 5,365,315 to Baker et al.

As the printer lid is closed, a charge roller mechanism is moved to shutter 5 and then continues to move downward to open shutter 5 by pushing it downward and to bring a charge roller in contact with photoconductor drum 49. A laser beam for discharging drum 49 is also directed through the opening left after shutter 5 is pivoted down, as is shown on U.S. Pat. No. 5,526,097 to Ream.

In summary, the photoconductor and cover assembly is located downwardly by front surfaces 449 and 451, is located downwardly by shaft 47 in V-block 301 and in the mirror image V-block and is held in the downward location by cantilevered roller 461 on surface 29*b* and the mirror image cantilevered roller on surface 29*a*. The developer assembly is located laterally by springs 132*a* and 132*b* moving the assembly so that developer roller 43 contacts the photoconductor drum 49, and is located downwardly by ledge 133*a* resting on roller 299 and ledge 161*a* resting on the mirror image roller to roller 299. The developer assembly requires no upward locator as it has sufficient weight not to displace upward.

Ledges 133*a* and 161*a* resting on roller 299 and a mirror image roller respectively permit the developer assembly to adjust laterally. In prior cartridges, both sets of rollers were in tracks in the cartridge. This required difficult tolerances to locate the bottom of the cartridge within the printer. In the subject cartridge, ledges 133*a* and 161*a* have no linked parts to the media guide ribs 223 and 225, which are in the same molded part as ledges 133*a* and 161*a*.

Figure 22:
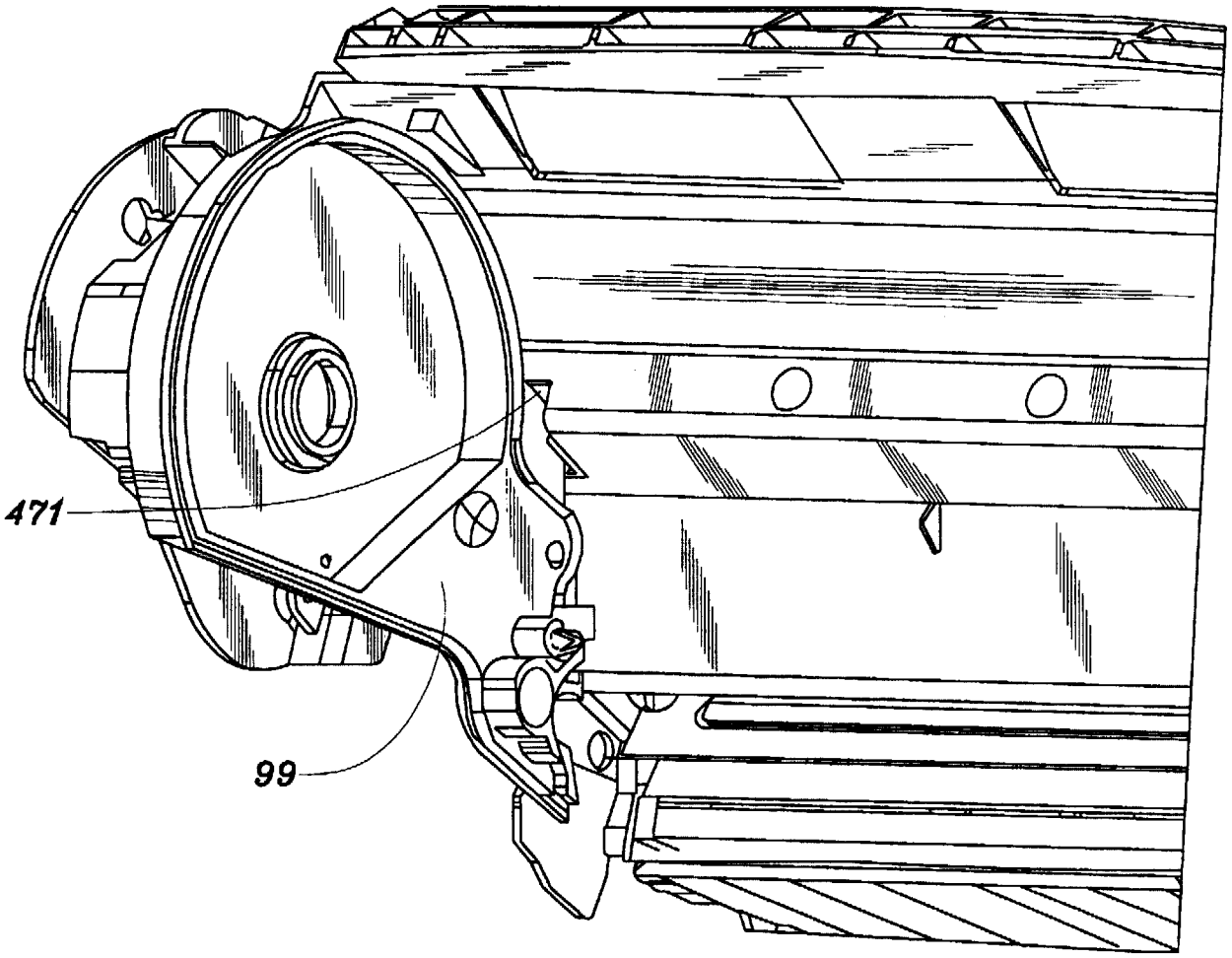
FIG. 22 shows the inside of the cover of the cartridge where it receives an extension from the hopper.

FIG. 22 shows an extension of side member 99 held in a slot 471 in the bottom of the cover 25. This provides lateral location between the hopper assembly and the cover 25. Generally similar lateral location structure is provided in previous cartridges. If desirable, the upper parts of end members 99 and 101 may have an upward ridge or bump, which will strike cover 25 during rough handling and thereby limit relative upward movement of the hopper assembly with respect to cover 25.

When installed in the printer, frame members contact left cover 31 and right cover 241 to assure they do not contact the hopper assembly and interfere with its free movement over roller 299 and its mirror image roller on ledges 133*a* and 161*a* respectively.

Venting By Plug

Plug 143 (FIG. 24) in a preferred form is a venting element which allows air to escape cartridge 1 while blocking toner. Cartridge 1 in the embodiment disclosed is designed to operate at high speed to print from 8 to 24 or more standard pages per minute. This operation generates a potentially detrimental internal pressure level during operation, which contributes to leaks of toner from cartridge 1. To relieve such pressure, plug 143 is a labyrinth design ending in a felt filter.

Figure 23:
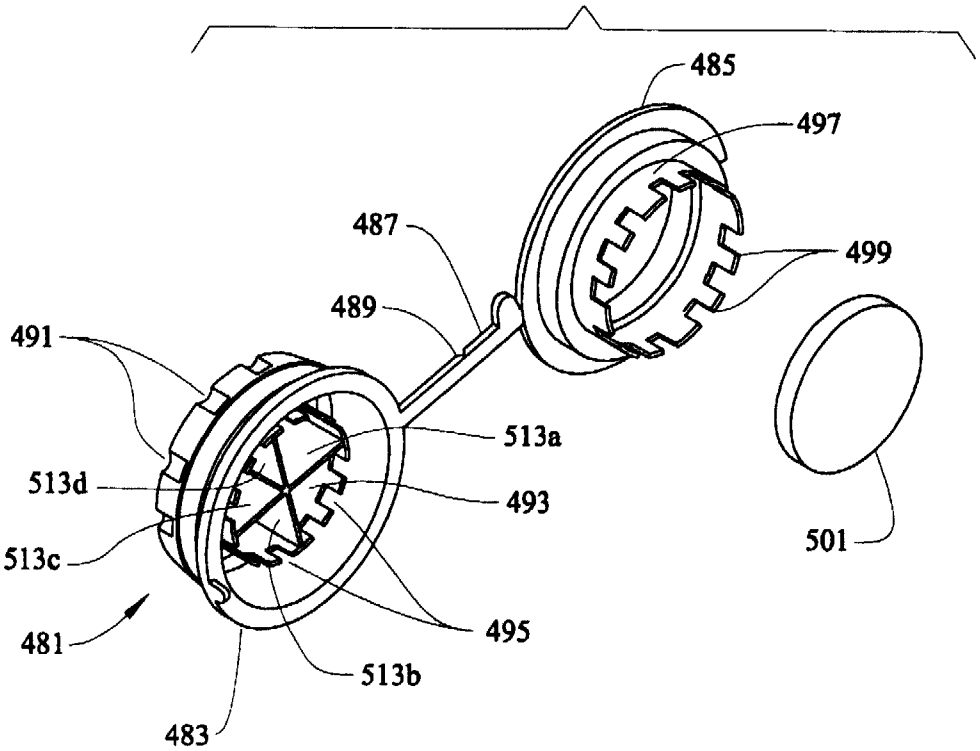
FIG. 23 shows elements of the hopper plug prior to assembly.

The leaks often, but not exclusively, occur immediately after the cartridge becomes inactive. Internal pressure in hopper 61 is created by ingesting air with toner 425 carried by the developer roller 43 past a seal (not shown) under the developer roller 43. The toner adder roller 45 pulls this air/toner mixture away from the developer roller which creates a pressure increase in hopper 61 until an equilibrium pressure is reached. As shown in FIG. 23, plug 143 is formed from a single molded part 481 having a circular base member 483 and a circular cap member 485 separated by a thin connecting arm 487, which has a central notch 489 to permit bending as a solid hinge.

Base 483 has a series of equally separated external holes 491 around the entire bottom circumference of base 483. Extending from the bottom of base 483 and located inward is a circular wall 493 having spaced rectangular openings 495 at the outer end of wall 493 equally spaced around the entire circumference of wall 493.

Similarly, cap 485 has a circular wall 497 extending from the top of cap 485 having spaced rectangular openings 499 at the outer end of wall 497 equally spaced around the entire circumference of wall 497. A disk 501 of standard F3 felt is pressed into the center of cap 485 where it contacts the inside of holes 503 (FIG. 24) in the center of cap 485.

Figure 24:
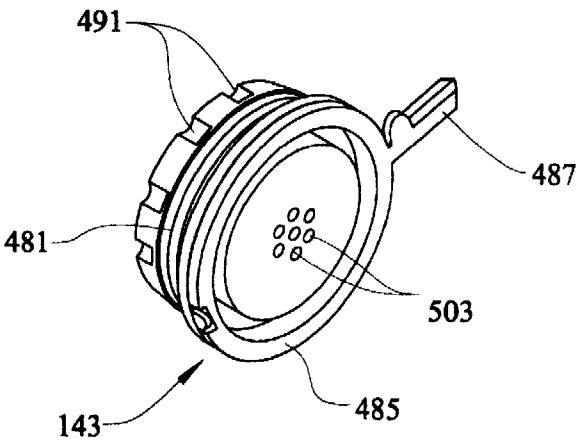
FIG. 24 shows the assembled hopper plug alone.
Figure 25:
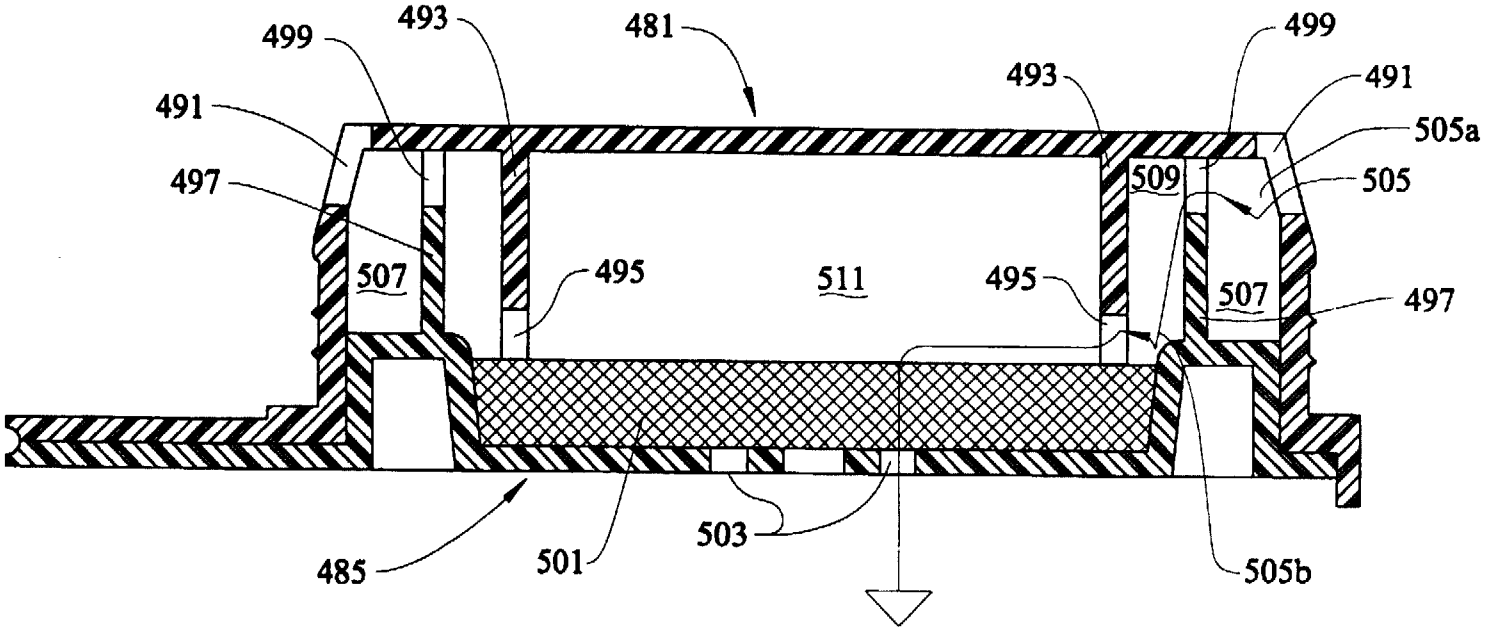
FIG. 25 shows a staggered cross section of the hopper plug to illustrate air flow.

To complete plug 143 as shown in FIG. 24, cap 485 and base 483 are intermeshed by folding arm 487 at hinge point 489. In this position no part of openings 499 is opposite external holes 491 and no part of openings 495 is opposite holes 499. FIG. 25 is a staggered cross section view of FIG. 24 which shows all of the openings 495 and 499 and indicates the staggered path by the angles 505*a* and 505*b* in discussion arrow 505.

As shown in FIG. 25, the plug is held together by a press fit in which the bottom circumference of base 483 is slightly smaller than the circumference of cap 485. In operation, when pressure increases in cartridge 1, air, potentially containing toner particles, enters holes 491 which are inside of hopper 61. That air enters circular chamber 507, as illustrated by arrow 505, and is blocked by wall 497 immediately opposite hole 491 and, therefore, must move right or left, as illustrated by bent arrow 505*a*, to reach openings 499. The air then enters chamber 509. That air is blocked by wall 493 and also must move right or left, as illustrated by bent arrow 505*b*, to reach openings 495, which are on the opposite end of chamber 509. Upon passing through openings 495, as shown by arrow 505, the air enters central chamber 511 and passes through felt filter 501 and then out of cartridge 1 through holes 503. (FIG. 23 shows four central flanges 513*a*–513*d*, which divide chamber 511 into four equal parts. However, flanges 513*a*–513*d* are for structural support of felt disk 501 and, functionally, chamber 511 can be a single chamber.) The labyrinth configuration of this construction of plug 143 results in continuing operation as an air vent with only minor accumulation of toner inside of the plug 143. The internal chambers 507, 509 and 511 are concentric circles.

We claim:

1. A toner cartridge comprising a first unitary element comprising hand grip at the top front end; a cleaner chamber at the rear end; and left and right side walls, each said side wall having a housing for loosely receiving a stud positioned in said housing; said element having openings near said chamber to mount a photosensitive roller, a second unitary member comprising a toner hopper, a post and a stud extending from each side of said hopper, and means to mount a developer roller for rotation to receive toner from said hopper, a first spring connected between said post of the left side of said second unitary member and said left side wall, a second spring connected between said post of the right side of said second unitary member and said right side wall, said stud of the left side of said cartridge positioned in said housing of said left side so as to be held by said housing of said left side, and said stud of the right side of said cartridge positioned in said housing of said right side so as to be held by said housing of said right side.

2. The cartridge as in claim 1 further comprising a flat ledge on the side of said hopper unobstructed for resting on a roller member in said imaging apparatus.

3. The cartridge as in claim 2 further comprising elongated top locator elements on opposite sides of said cartridge in the center of said cartridge.

4. The cartridge as in claim 3 having curved planar members on opposite sides of said cartridge for guided movement, said planar members being substantially continuous with respect to being guided by substantially continuous slots and also comprising a lower shutter mounted on a link on each side to rotate said shutter forward and upward, each said link being integral with an actuator surface located generally above each of said planar members so that insertion of said planar members in a slot will rotate said actuator surfaces toward said wings, said rotation moving said shutter forward and upward.

5. The cartridge as in claim 4 also comprising locating surfaces on each side of said cartridge comprising a central shaft of said photosensitive roller extending so that said central shaft is unobstructed for serving as a lower locator.

6. The toner cartridge as in claim 5 in which said hopper contains electrophotographic toner for developing electrostatic images.

7. The toner cartridge as in claim 1 in which said hopper contains electrophotographic toner for developing electrostatic images.

8. The toner cartridge as in claim 2 in which said hopper contains electrophotographic toner for developing electrostatic images.

9. The toner cartridge as in claim 3 in which said hopper contains electrophotographic toner for developing electrostatic images.

10. The toner cartridge as in claim 4 in which said hopper contains electrophotographic toner for developing electrostatic images.

* * * * *